US007823357B2

(12) United States Patent
Westra

(10) Patent No.: US 7,823,357 B2
(45) Date of Patent: Nov. 2, 2010

(54) LIVE FIRE BURN ROOM AND INSULATING SYSTEM FOR A LIVE FIRE BURN ROOM

(75) Inventor: Steven P. Westra, De Forest, WI (US)

(73) Assignee: Fire Facilities, Inc., Sun Prairie, WI (US)

( * ) Notice: Subject to any disclaimer, the term of this patent is extended or adjusted under 35 U.S.C. 154(b) by 661 days.

(21) Appl. No.: 10/434,993

(22) Filed: May 9, 2003

(65) Prior Publication Data

US 2004/0221518 A1 Nov. 11, 2004

(51) Int. Cl.
*E04B 1/343* (2006.01)

(52) U.S. Cl. ..... 52/573.1; 52/1; 52/64; 52/459

(58) Field of Classification Search ..... 52/1, 52/64, 309.14, 407.4, 459, 79.1, 267–270, 52/573.1, 259, 29, 275–276, 287.1, 288.1, 52/309.9, 393, 396.01, 396.04, 460; 62/259.1
See application file for complete search history.

(56) References Cited

U.S. PATENT DOCUMENTS

| | | | | | |
|---|---|---|---|---|---|
| 2,211,384 | A | * | 8/1940 | Patterson | 52/263 |
| 3,393,920 | A | * | 7/1968 | Ehrlich | 296/181.6 |
| 3,755,976 | A | * | 9/1973 | Dolhaine | 52/93.1 |
| 3,820,295 | A | * | 6/1974 | Folley | 52/270 |
| 3,974,607 | A | * | 8/1976 | Balinski | 52/232 |
| 3,998,016 | A | * | 12/1976 | Ting | 52/323 |
| 4,299,065 | A | * | 11/1981 | Fairgrieve | 52/79.7 |
| 4,854,094 | A | * | 8/1989 | Clark | 52/79.1 |
| 4,882,883 | A | * | 11/1989 | Horn | 52/79.1 |
| 5,167,098 | A | * | 12/1992 | Blackwelder | 52/91.1 |
| 5,203,707 | A | * | 4/1993 | Musto et al. | 434/226 |
| 5,316,484 | A | | 5/1994 | Layton et al. | |
| 5,706,614 | A | * | 1/1998 | Wiley et al. | 52/79.1 |
| 6,076,320 | A | * | 6/2000 | Butler | 52/294 |
| 6,205,725 | B1 | * | 3/2001 | Butler | 52/292 |
| 6,293,069 | B1 | * | 9/2001 | Monda et al. | 52/460 |
| 6,889,473 | B2 | * | 5/2005 | Westra | 52/64 |

OTHER PUBLICATIONS

Fire Facilities Inc., "Typical Westemp Layout—Installation of 'Westemp'", Installation Drawings, Dec. 8, 2000, 3 pages, Fire Facilities Inc., Sun Prairie, Wisconsin, USA.
Fire Facilities Inc., "Wesco Burn Rooms", Installation Instructions and Owners Manual, Dec. 8, 2000, 16 pages, Fire Facilities Inc., Sun Prairie, Wisconsin, USA.

* cited by examiner

*Primary Examiner*—Richard E Chilcot, Jr.
*Assistant Examiner*—Chi Q Nguyen
(74) *Attorney, Agent, or Firm*—Joseph W. Byrne

(57) ABSTRACT

A live fire burn room and an insulating system for a live fire burn room are disclosed. The burn room includes a structural framework. The insulating system includes a face panel, at least one face panel mounting bracket for attaching the face panel to the structural framework of the burn room, and an insulating layer disposed between the face panel and the structural framework of the burn room.

78 Claims, 14 Drawing Sheets

LIVE FIRE BURN ROOM AND INSULATING SYSTEM FOR A LIVE FIRE BURN ROOM

FIELD OF THE INVENTION

The present invention relates generally to a firefighter training apparatus and system. More specifically, it relates to a live fire burn room and an insulating system for a live fire burn room that can be incorporated into firefighter training structures and towers.

BACKGROUND OF THE INVENTION

Live firefighter training exercises typically involve the use of a training tower or other training structure specially designed for the purpose of training firefighters. These structures generally include two or more rooms. Simple training structures, for example, may have only two rooms. One of the rooms is typically designed to accommodate the fire used in live firefighter training. The other room is provided for the purpose of allowing firefighters to enter the structure to put out the live training fire. Other more sophisticated training structures may have several rooms and several floors, including two or more rooms that are specially designed to contain live training fires.

Firefighter training structures are typically made from either concrete or steel. These materials are susceptible to damage from high heat and high temperatures. When concrete is heated to a surface temperature of 650 degrees Fahrenheit, for example, it begins to lose its inherent moisture and at 750 to 850 degrees, the surface begins to powder leading to continued deterioration. Hot rolled steel will distort at 1000 degrees Fahrenheit and cold rolled steel can fail at temperatures as low as 800 degrees Fahrenheit. The structural framework and components of training structures made from these materials, therefore, must be protected from exposure to the intense heat that can be generated by a live training fire.

The room (or rooms) in a training structure that actual contains the live training fire is referred to as the burn room or live fire burn room. Burn rooms can withstand continuous exposure to intense heat from live training fires without sustaining damage because of their special design. For example, some burn rooms can withstand continuous internal temperatures of greater than 1000 degrees Fahrenheit inside of the burn room during an entire firefighter training exercise without sustaining damage. Other burn rooms have the capability of withstanding continuous temperatures up to and including 1200 degrees Fahrenheit inside of the burn room throughout an entire firefighter training exercise without sustaining damage. Some other burn rooms can even withstand continuous temperatures of greater than 1200 degrees Fahrenheit inside of the burn room throughout an entire firefighter training exercise without sustaining damage.

Many burn rooms are also designed to keep the intense heat generated by live training fires inside of the burn room. This is usually accomplished by insulating both the walls and the ceiling of the burn room. As previously discussed, it is desirable to keep the heat from live training fires inside of the burn room to protect the structural integrity of both the burn room and the remainder of the training structure.

The walls and ceiling of prior art live fire burn rooms, like the other structural components of firefighter training structures, have typically been made of concrete or rolled steel. In one type of prior art concrete burn room, for example, the walls and ceiling of the burn room are made from concrete or concrete block. The inside surfaces of the concrete or concrete block walls and ceiling are lined with special refractory concrete or refractory tiles. The refractory concrete or tiles protect the concrete walls and ceiling from damage that would otherwise result from the heat generated inside of the burn room by the live training fire.

The problem with refractory concrete or refractory tiles is that these materials do not provide good insulation. As a result, the heat generated inside of the burn room by live training fires has a propensity to escape out of the burn room and into the remainder of the training structure. In addition, refractory concrete and tiles are subject to damage from impact with foreign objects and these materials are expensive to replace.

Other prior art burn rooms have walls and a ceiling that are constructed using conventional framing members. These prior art burn rooms, for example, have walls and ceilings that are framed in using wall studs and ceiling joists made from either metal or wood. The wall studs and ceiling joists are covered with special insulating panels that protect these structural components from the heat generated inside of the burn room. These insulating panels also provide adequate insulation to keep the heat generated by the training fire inside of the burn room and away from the structural components of the burn room and the remainder of the training structure.

FIG. 1 shows the construction of a prior art burn room wall 100 having a conventional steel framework as discussed above. The structural framework of wall 100 is comprised of a plurality of equally spaced apart, vertically oriented, framing members or wall studs 102. Attached to wall studs 102 are a plurality of horizontally oriented steel hat channel members 104. Hat channel members 104 are perpendicularly attached to wall studs 102 and are equally spaced apart between the top and bottom of wall 100.

A plurality of insulating panels 106 are mounted to hat channel members 104. The insulating panels are typically 4 feet by 4 feet in size and are typically 1 inch thick. Insulating panels 106 are mounted to hat channel members 104 using conventional metal mounting screws 108 and plate washers 110. Screws 108 are typically inserted into holes 112 that are drilled completely through insulating panels 106. Thus, each mounting screw 108 penetrates from the inside of the burn room completely through an insulating panel 106 and into a metal hat channel 104 in this prior art system.

The diameter of each hole 112 is typically larger than the diameter of screws 108. For example, the diameter of each hole 112 may be on the order of ½ inch in diameter while the diameter of each screw 108 may only be ⅛ inch. The reason for providing oversized mounting holes is to allow for movement and slippage of the individual insulating panels 106 as they expand and contract with increases and decreases of temperature inside of the burn room.

Each panel 106 is mounted side-by side next to an adjacent panel, 106. Small gaps 114 are provided between adjacent panels 106 to further allow for expansion of the panels as the temperature in the burn room rises during usage. To prevent heat from escaping through gaps 114, narrow insulating batten strips 116 are mounted to hat channels 104 behind each gap 114. Hat channel spacers 118 are also provided at the center of each panel to account for the thickness of the insulating batten strips 116 that are disposed around the perimeter of each panel 106.

Insulating panels 106 and insulating battens 116 are generally made from calcium silicate boards that have been specially treated to protect them from water damage that would otherwise result from the water used during firefighter training exercises. Insulating panels pre-cut to the 4 foot by 4 foot by 1 inch size are sold by the present assignee of this application under the brand name Westemp®. Insulating panels in other sizes are also readily available. Batten strips 116 are generally pre-cut to the desired size at the factory prior to installation.

Although the prior art insulating system shown in FIG. 1 generally provides for adequate insulation to protect the structural framework and components of the burn room and training structure, it too suffers from several drawbacks. To begin with, the individual insulating panels 106 are expensive to replace. This is important because, in general, they have a limited useful life after which time they must be replaced. The panels are also susceptible to damage from impacts with foreign objects and to premature spalling and/or cracking that can result from various environmental conditions present in the burn room during firefighter training exercises (e.g., various heat/moisture conditions). Damaged panels as well as panels that show signs of significant cracking and/or spalling may also require replacement.

Proper installation of insulating panels 106 is also difficult to achieve. This is because as the panels heat up, they have a tendency to move and slip due to warpage and expansion. To allow for this movement, mounting screws 108 must be adjusted properly. If mounting screws 108 are over tightened, the insulating panels will crack at the location of the mounting screws because they will not have the ability to expand and move properly at those locations.

To further complicate matters, the greater the rise in temperature, the greater the expansion and warpage that results. What may be an adequate adjustment of mounting screws 108 at one temperature may not allow for adequate expansion and movement of the insulating panels at a higher temperature. Furthermore, if the screws are left too loose, the panels will not be properly secured to the walls when the burn room is at lower temperatures such as normal room temperature. Excessive warranty costs can be incurred to replace insulating panels that are damaged as a result of improper installation.

Another problem with the prior art insulating system of FIG. 1 is that the insulating system does not provide a complete thermal block between the inside of the burn room and the metal structural framework of the burn room. This is because the metal mounting screws that secure the insulating panels in place penetrate completely through those insulating panels. Thus, the metal mounting screws breach the layer of insulation that is provided to insulate the inside of burn room from the structural framework of the burn room.

It is desirable, therefore to have a live fire burn room that does not suffer from the drawbacks present with the prior art systems. Preferably, the live fire burn room will have an insulating system for which proper installation is easily achieved. The insulating system will also preferably have an unlimited useful life and will not be subject to damage from impacts with foreign objects or from environmental factors. Finally, the insulating system will also preferably provide a complete thermal block wherein none of the insulating system mounting components will penetrate through the insulation layer that is provided to shield the burn room from the remainder of the training structure.

SUMMARY OF THE PRESENT INVENTION

According to a first aspect of the invention, an apparatus for training firefighters includes a burn room, a first wall face panel and a first layer of insulation. The burn room includes a ceiling, a floor, and a first wall disposed between the ceiling and the floor. The first wall face panel is attached to the first wall and is exposed to the inside of the burn room. The first layer of insulation is disposed between the first wall face panel and the first wall.

The first wall face panel is a stainless steel panel, a floating wall face panel or a corrugated face panel in alternative embodiments. The first wall includes a plurality of wall studs in one embodiment and is a concrete wall in another embodiment. The first wall face panel is attached to the first wall in a manner that allows the first wall face panel to move in response to temperature changes inside of the burn room in one other embodiment.

A plurality of face panel mounting fasteners attach the first wall face panel to the first wall in one other embodiment. The first layer of insulation is disposed between each face panel mounting fastener and the first wall in this embodiment. The apparatus includes a ceiling face panel attached to the ceiling and exposed to the inside of the burn room in one embodiment. A layer of insulation is disposed between the ceiling face panel and the ceiling in this embodiment.

The first wall face panel and the ceiling face panel are configured inside of the burn room to move independently of each other as the temperature inside of the burn room rises and falls in another embodiment and the first wall face panel is not physically attached to the ceiling face panel other than indirectly through the wall and the ceiling in an alternative embodiment. The first wall face panel is attached to the ceiling face panel in a manner that allows the first wall face panel and the ceiling face panel to each move as the temperature inside of the burn room changes in yet another embodiment.

In one embodiment, a corner trim member is attached to the first wall face panel and the ceiling face panel. The corner trim member flexes to allow the first wall face panel and the ceiling face panel to move in response to temperature changes inside of the burn room in this embodiment. The corner trim member is attached between the first wall face panel and the ceiling face panel in another embodiment and includes at least one flex joint that allows the first wall face panel and the ceiling face panel to move in response to temperature changes inside of the burn room. The wall face panel and the ceiling face panel are corrugated face panels in yet another embodiment.

The apparatus includes at least one face panel mounting member in one embodiment and a plurality of face panel mounting members in another embodiment disposed between the first wall face panel and the first wall in those embodiments. An insulating strip is disposed between each face panel mounting member and the first wall face panel in one other embodiment. Each of the face panel mounting members is a z-shaped mounting member or a u-shaped mounting member in other embodiments.

In one embodiment, the layer of insulation includes at least one insulating blanket disposed between adjacent spaced apart z-shaped mounting members. Each of the face panel mounting members displaces the first wall face panel away from the first wall in one embodiment and each includes a flex member that allows the first wall face panel to move as the temperature inside of the burn room changes in another embodiment. The flex member is also a displacement member in an alternative embodiment.

Each of the face panel mounting members includes a displacement member disposed between the first wall face panel and the first wall in another embodiment. The angle of orientation of the displacement member changes as the first wall face panel moves in response to changes in temperature inside of the burn room in this embodiment.

In another embodiment, the apparatus includes a plurality of face panel mounting fasteners attaching the first wall face panel to the plurality of face panel mounting members. The first layer of insulation is disposed between each face panel mounting fastener and the first wall in this embodiment. The first layer of insulation is comprised of at least one insulating blanket disposed between adjacent spaced apart face panel mounting members in another embodiment and a portion of the first layer of insulation is disposed between adjacent spaced apart face panel mounting members in an alternative embodiment.

The apparatus includes a second wall, a second wall face panel and a second layer of insulation in another embodiment. The second wall adjoins the first wall and is disposed between the ceiling and the floor. The second wall face panel is attached to the second wall and is exposed to the inside of the live fire burn room. The second layer of insulation is disposed between the second wall face panel and the second wall. The second wall face panel is not physically attached to the first wall face panel other than indirectly through the first and second walls in one embodiment.

The apparatus also includes a ceiling face panel and a ceiling layer of insulation attached to the ceiling in one other embodiment. The ceiling face panel is exposed to the inside of the burn room. The ceiling layer of insulation is disposed between the ceiling face panel and the ceiling.

The second wall face panel and the first wall face panel are configured inside of the burn room to move independently of each other as the temperature inside of the burn room changes in one embodiment. The second wall face panel and the ceiling face panel are configured inside of the burn room to move independently of each other as the temperature inside of the burn room changes in another embodiment. The first wall face panel is attached to the ceiling face panel in a manner that allows the first wall face panel and the ceiling face panel to each move as the temperature inside of the burn room changes in yet another embodiment.

The apparatus includes a corner trim member attached to the first wall face panel and the ceiling face panel in one other embodiment. The corner trim member flexes to allow the first wall face panel and the ceiling face panel to move as the temperature inside of the burn room changes in this embodiment. The first wall face panel, the second wall face panel and the ceiling face panel are all corrugated face panels in another embodiment.

The second wall face panel is not physically attached to the first wall face panel other than indirectly through the first and second walls in one embodiment and the second wall face panel is not physically attached to the ceiling face panel other than indirectly through the wall and the ceiling in another embodiment. The first wall face panel is attached to the ceiling face panel in a manner that allows the first wall face panel and the ceiling face panel to each move as the temperature inside of the burn room changes in yet another embodiment.

According to a second aspect of the invention, an insulating system for a burn room having a ceiling and a wall includes a first face panel, a first plurality of spaced apart face panel mounting members and a first layer of insulation. The first face panel has a front side and a back side. The first plurality of spaced apart face panel mounting members are attached to the back side of the first face panel and each is configured for attachment to the burn room. The first layer of insulation is disposed adjacent to the back side of the first face panel.

The first face panel is a stainless steel panel in one embodiment and is a corrugated face panel in another embodiment. The first face panel is configured for attachment to the burn room in a manner that allows the first wall face panel to move in response to temperature changes inside of the burn room in one embodiment. The first wall includes a plurality of wall studs and each of the first plurality of face panel mounting members is configured for attachment to the wall studs in another embodiment. In an alternative embodiment, the first wall is a concrete wall and each of the first plurality of face panel mounting members is configured for attachment to the concrete wall.

The insulating system includes a second face panel having a front side and a back side, a second plurality of spaced apart face panel mounting members and a second layer of insulation in another embodiment. The second plurality of spaced apart face panel mounting members are attached to the back side of the second face panel and each is configured for attachment to the burn room. The second layer of insulation is disposed adjacent to the back side of the second face panel.

In one embodiment, the first face panel and the second face panel are configured to move independently of each other as the temperature inside of the burn room increases and decreases. The insulating system is configured such that the first face panel is disposed for attachment to the wall of the burn room and the second face panel is disposed for attachment to the ceiling of the burn room in another embodiment and is configured such that the first face panel is not physically attached to the second face panel other than indirectly through the burn room when the insulating system is installed in the burn room in one other embodiment. The first face panel is attached to the second face panel in a manner that allows the first face panel and the second face panel to each move as the temperature inside of the burn room changes in another embodiment.

The insulating system includes a corner trim member attached to the first face panel and to the second face panel in another embodiment. The corner trim member includes a flex member that allows the first face panel and the second face panel to move in response to temperature changes inside of the burn room in this embodiment. In another embodiment, the corner trim member is attached between the first face panel and the second face panel and includes a flex joint that allows the first face panel and the second face panel to move in response to temperature changes inside of the burn room. The first face panel and the second face panel are corrugated face panels in yet one other embodiment.

In another embodiment, the insulating system includes a third face panel having a front side and a back side, a third plurality of spaced apart face panel mounting members attached to the back side of the third face panel and a third layer of insulation disposed adjacent to the back side of the third face panel. The third plurality of face panel mounting members is configured for attachment to the burn room in this embodiment.

The second face panel and the first face panel are configured to move independently of each other as the temperature inside of the burn room changes in one embodiment and the second face panel and the third face panel are configured to move independently of each other as the temperature inside of the burn room changes in another embodiment. The first face panel is attached to the third face panel in a manner that allows the first face panel and the third face panel to each move as the temperature inside of the burn room changes in still another embodiment.

The insulating system includes a corner trim member attached to the first face panel and to the third face panel in another embodiment. The corner trim member flexes to allow the first face panel and the third face panel to move as the temperature inside of the burn room changes in this embodiment. The first face panel, the second face panel and the third face panel are all corrugated face panels in one other embodiment.

In one embodiment, the insulating system includes an insulating strip disposed between each of the first plurality of face panel mounting members and the first face panel. Each of the face panel mounting members is a z-shaped mounting member or a u-shaped mounting member in two alternative embodiments. The first layer of insulation includes at least one insulating blanket disposed between adjacent spaced apart z-shaped mounting members in another embodiment. Each of the face panel mounting members displaces the first face panel away from the burn room in one embodiment, includes a flex member that allows the first face panel to move in response to temperature changes inside of the burn room in another embodiment, and includes a displacement member in a third embodiment. The angle of orientation of the displacement member changes as the first face panel moves in response to changes in temperature inside of the burn room in this third embodiment.

The insulating system includes a plurality of face panel mounting fasteners attaching the first face panel to the first plurality of face panel mounting members in one embodiment. The insulating system is configured such that the layer of insulation is disposed between each face panel mounting fastener and the burn room when the insulating system is installed in the burn room in this embodiment. The first layer of insulation is comprised of at least one insulating blanket disposed between adjacent spaced apart face panel mounting members in another embodiment. A portion of the layer of insulation is disposed between adjacent spaced apart face panel mounting members in one other embodiment.

According to a third aspect of the invention, an apparatus for training firefighters includes a burn room, a wall face panel and a ceiling face panel. The burn room includes a ceiling, a floor, and a wall disposed between the ceiling and the floor. The wall face panel is a corrugated wall face panel and is attached to the wall and disposed on the inside of the burn room. The ceiling face panel is also a corrugated face panel and is attached to the ceiling and disposed on the inside of the burn room.

In one embodiment, the apparatus includes a first insulating layer disposed between the wall face panel and the wall and a second insulating layer disposed between the ceiling face panel and the ceiling. In another embodiment, the apparatus includes a plurality of wall face panel mounting brackets connecting the wall face panel to the wall and a plurality of ceiling face panel mounting brackets connecting the ceiling face panel to the ceiling. The wall and ceiling face panel mounting brackets are z-shaped mounting brackets in yet another embodiment.

A portion of the first insulating layer is disposed between adjacent wall face panel mounting brackets and a portion of the second insulating layer is disposed between adjacent ceiling face panel mounting brackets in another embodiment. The insulating system includes an insulating strip disposed between each of the wall face panel mounting brackets and the wall face panel and between each of the ceiling face panel mounting brackets and the ceiling face panel in one other embodiment. In another embodiment, the insulating system includes a plurality of wall face panel mounting fasteners attaching the wall face panel to the plurality of wall face panel mounting members and a plurality of ceiling face panel mounting fasteners attaching the ceiling face panel to the plurality of ceiling face panel mounting members. The first insulating layer is disposed between each wall face panel mounting fastener and the wall and the second insulating layer is disposed between each ceiling face panel mounting fastener and the ceiling in this embodiment.

According to a fourth aspect of the invention, an insulating system for insulating a burn room having a structural framework, the insulating system includes a plurality of face panel mounting members configured for attachment to the structural framework, a plurality of insulating strips, a face panel attached to the plurality of insulating strips and at least one insulating blanket disposed adjacent to the face panel between adjacent face panel mounting members. Each one of the plurality of insulating strips is attached to a corresponding one of the face panel mounting members.

The face panel is a corrugated face panel in one embodiment and each of the face panel mounting members is a z-shaped mounting member in another embodiment.

Other principal features and advantages of the invention will become apparent to those skilled in the art upon review of the following drawings, the detailed description and the appended claims.

BRIEF DESCRIPTION OF THE DRAWINGS

The drawings, which constitute a part of the specification, are as follows.

Figure 1:
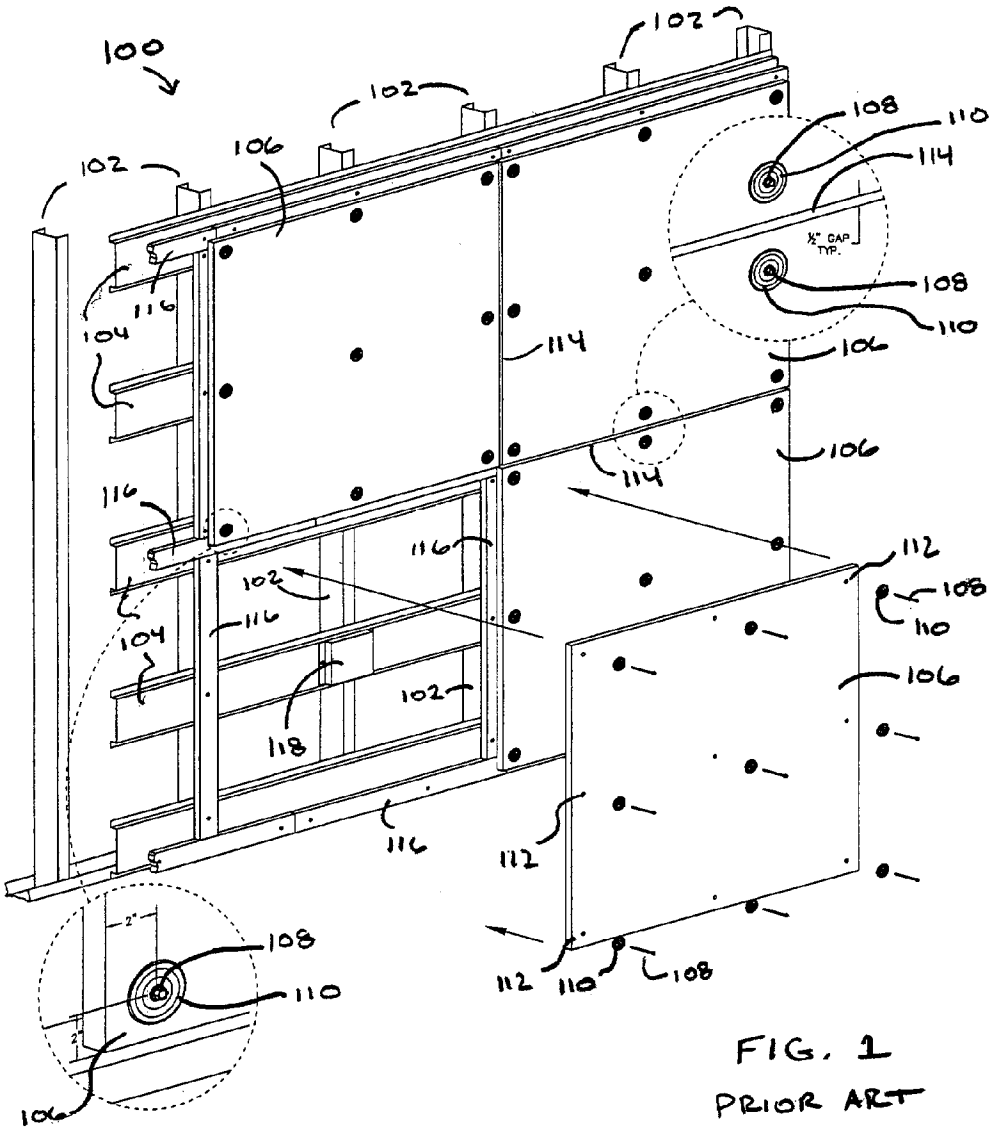
FIG. 1 PRIOR ART
FIG. 1 shows a partially exploded isometric view of a prior art live fire burn room wall.

Before explaining at least one embodiment of the present invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular live fire burn room and a particular insulating system having particular configurations and particular features, the present invention is not limited to these configurations or to these features and other configurations and other features can be used. Also, although the present invention will be illustrated with reference to using the burn room and insulating system in connection with firefighter training structures, the present invention may have use in other applications and other industries as well. For example, the insulation system of the present invention may be used to insulate rooms other than burn rooms.

Generally, the present invention involves a live fire burn room and an insulating system for a live fire burn room. The term burn room, or live fire burn room, as used herein, means a room that is specially designed to contain a continuous live training fire during a firefighter training exercise without sustaining damage to the room. The terms burn room and live fire burn room do not include rooms that are not specially designed or intended for this purpose.

The burn room is generally comprised of a floor, a ceiling, and a plurality of walls disposed between the floor and the ceiling. The walls and ceiling of the live fire burn room can be comprised of either concrete, including concrete blocks, conventional framing components, or a combination of both concrete and conventional framing components. In one embodiment of the present invention, for example, the structural framework of the burn room includes a plurality of spaced apart steel wall studs and ceiling joists. Structural framework, as used herein, means the underlying structures that make up the walls and/or ceiling of burn rooms including, but not limited to, wall studs, ceiling joists, poured concrete and concrete blocks.

The insulating system for the walls of the burn room includes a corrugated metal wall face panel attached to the walls of the burn room (e.g., to the wall studs). The front side of the wall face panel is exposed to the inside of the burn room and thus to the flames from live training fires. The corrugations or ribs run in the vertical direction in this embodiment. In other embodiments, however, there are no corrugations on the wall face panels or the corrugations run in the horizontal direction.

The vertically oriented corrugations in this embodiment allow for expansion and contraction of the corrugated face panel in the horizontal direction (e.g., in the direction perpendicular to the direction of the corrugations) without significant changes in the overall width of the corrugated panel in the horizontal direction and without incurring warping and/or heat damage to the panel. This is because the corrugations act as absorbing members in that expansion and contraction of the corrugated face panel is absorbed by the corrugations themselves. Because the overall width of the wall face panels change only minimally in the horizontal direction, little interference is encountered between corrugated wall face panels and adjoining walls (and any wall face panels mounted to adjoining walls) as the corrugated wall face panels expand and contract with temperature fluctuations inside of the burn room.

The wall face panels are attached to the walls of the burn building via a plurality of spaced apart face panel mounting brackets or members (expansion/contraction mounting brackets or members) that are attached to the back side of each wall face panel. In one embodiment, for example, the face panel mounting members attach the back side of the wall face panel to the wall studs of the burn room. In other embodiments, the mounting members attach the corrugated wall face panels directly to concrete walls or concrete block walls.

The face panel mounting brackets in one embodiment are z-shaped channel members or brackets that are attached horizontally to the walls of the burn room. The z-shaped brackets are attached perpendicular to the wall studs of the burn room in this embodiment. Each z-shaped member has an upwardly directed rear leg that attaches to the wall studs and a downwardly directed front leg that attaches either directly or indirectly (e.g., through an insulating strip) to the back side of the corrugated wall face panel. The upwardly directed rear leg and the downwardly directed front leg of the z-shaped channel members are connected to each other by way of a single middle displacement member or hinge member that is generally oriented in a horizontal direction. The displacement member displaces the wall face panel away from the wall and the structural framework of the wall.

In other embodiments of the present invention, the z-shaped mounting member is reversed. In these embodiments, the leg that attaches to the wall studs projects downward and the leg that attaches to the back side of the wall face panel (either directly or through an insulating strip) projects upward.

Z-shaped member or bracket, as used herein, means a member or bracket that includes a middle or center leg or member (e.g., the displacement member), a first outer leg attached to or near one end of the middle member and projecting in a first direction away from the middle member, and a second outer leg attached to or near the opposite end of the middle member and projecting in a second direction away from the middle member, wherein the second direction is opposite or generally opposite to the first direction. The angles between the middle member and the outer legs may be ninety degrees, greater than ninety degrees, or less than ninety degrees.

Using the z-shaped channel members to connect the corrugated wall face panel to the structural framework of the burn room allows the corrugated wall face panel to move or to float in the vertical direction (e.g., parallel to the direction of the corrugations) as the temperature in the burn room rises and falls without warping and/or heat damage occurring. This results because the middle leg of each z-shaped channel member, which connects the back side of the corrugated face panel to, and displaces it from, the structural framework of the burn room, acts as a flex member in that it flexes upwards and downwards with movement of the attached wall face panel. Viewed from another perspective, the middle displacement leg of the z-shaped mounting member, which extends horizontally (or substantially horizontally) outward from the wall at room temperature, has the ability to change its generally horizontal orientation to an angled orientation as the corrugated wall face panel is forced upward or downward (in a direction that is parallel to the direction of the corrugations) as a result of expansion or contraction of the wall face panel.

It should also be noted that the present invention is not limited to the use of z-shaped mounting members and other types of face panel mounting brackets or members can be used. Face panel mounting bracket or member, as used herein, means any mounting member or bracket configured for connecting a face panel to a wall or ceiling of a burn room that allows the face panel to move independently of the wall or ceiling as the face panel expands and contracts due to temperature changes inside of the burn room. For example, in other embodiments of the present invention, u-shaped or inverted u-shaped channel mounting members having a center member are used. The center member of the u-shaped channel member is both a displacement member and a flex member. In yet other embodiments, stand off screws are used or some other type of structure is used as a face panel mounting member.

Disposed between the wall of the burn room and the back side of the wall face panel is a separate insulating layer. In one embodiment, the insulating layer is comprised of a plurality of insulating blankets or blanket sections each of which is disposed immediately adjacent to the back side of the corrugated wall face panel and between an adjacent pair of z-shaped channel members. Narrow insulation strips are also provided between the back side of the wall face panels and the face panel mounting members in this embodiment.

The ceiling of the burn room is constructed in the same manner as the walls in one embodiment. For example, the ceiling of the live fire burn room includes a corrugated metal ceiling face panel attached to the underside of the ceiling joists using a plurality of z-shaped channel members. The ceiling face panel is exposed to the inside of the burn room and thus to the live training fire and the flames from the live training fire.

The corrugations or ribs of the ceiling panel run parallel to the ceiling joists in this embodiment. The corrugations allow the face panel to expand in a direction perpendicular to the corrugations as the temperature inside of the burn room rises and falls and the z-shaped channel brackets allow the face panel to move or float in the direction parallel to the corrugations as the temperature inside of the burn room rises and falls due to expansion and contraction of the panel. An insulating layer is provided between the back side (e.g. upper side) of the corrugated ceiling face panel and the underside of the ceiling joists and narrow insulation strips are provided between the back side of the ceiling face panel and the z-shaped mounting members.

Figure 2:
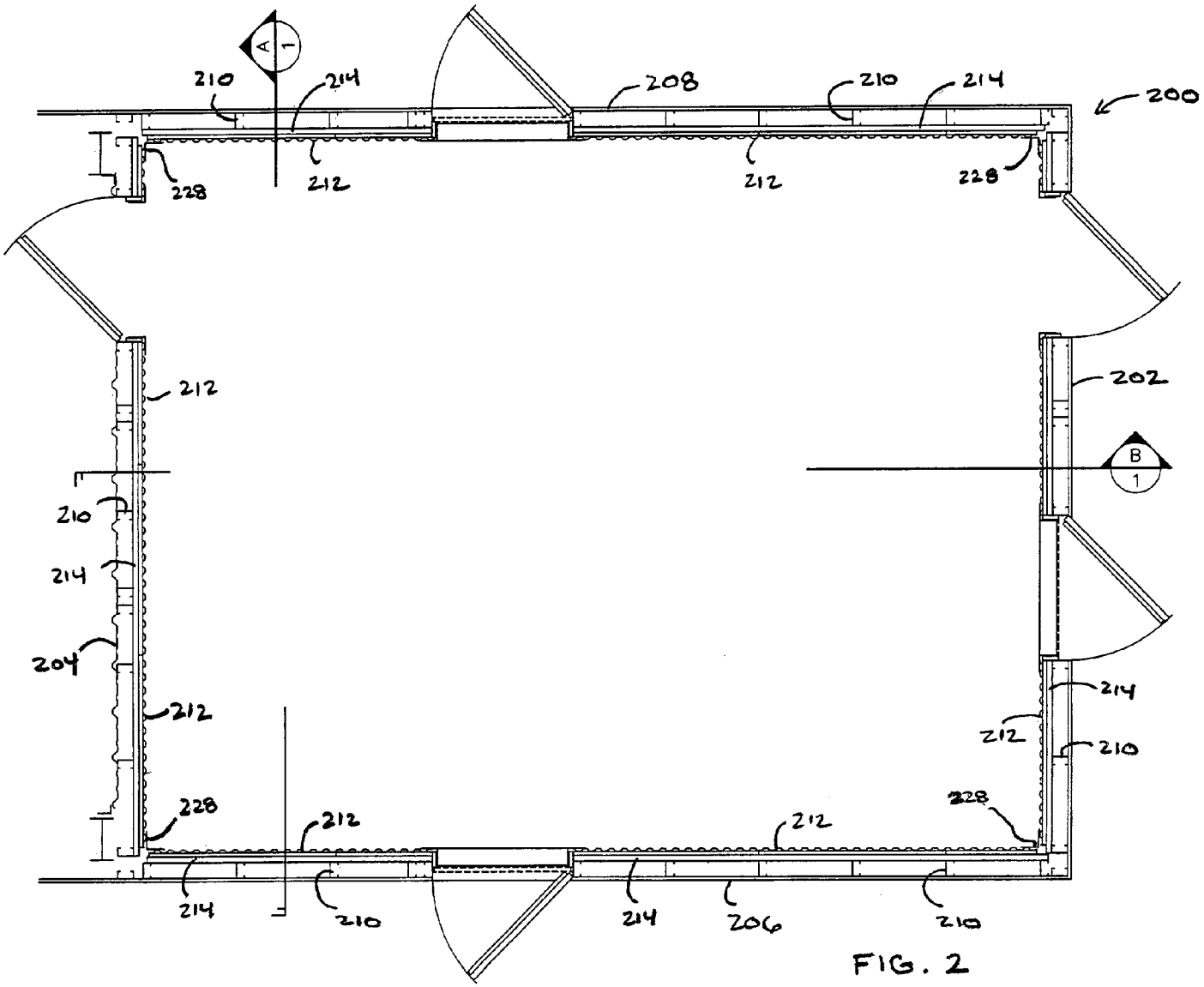
FIG. 2 shows a floor plan view of a live fire burn room according to one embodiment of the present invention.

A live fire burn room 200 according to one embodiment of the present invention is shown in FIG. 2 having front and back walls 202 and 204 respectively and side walls 206 and 208. Burn room 200 also includes a ceiling and floor which are not shown in FIG. 2. The ceiling of burn room 200 according to this embodiment of the present invention is constructed in a similar manner to that of the various walls 202-208 and will be described in more detail later herein.

The floor of burn room 200 is typically constructed from poured concrete or some type of fire resistant block or brick. However other materials can be used for the floor including metal. Floor, as used herein, means any surface, including the ground, disposed under the walls of the burn room, regardless of whether the surface is physically attached to the walls and regardless of whether the surface is flat.

The structural framework of each of walls 202 through 208 is comprised of a plurality of steel wall studs 210 which are vertically oriented and equally spaced apart along the length of each wall. Corrugated wall face panels 212 are attached to the walls around the inside of burn room 200. The corrugated wall face panels in one embodiment of the present invention are made of 24 gauge stainless steel. In other embodiments, the corrugated wall face panels are made from other metals such as galvanized steel or from some other type of heat resistant material.

Disposed between each wall face panel 212 and wall studs 210 around the perimeter of burn room 200 is an insulating layer 214. Insulating layer 214 is disposed on the outside of burn room 200 adjacent to corrugated wall panels 212 and is provided to keep the heat generated inside of burn room 200 from reaching the structural framework of burn room 200 or for that matter, the structural framework of any other portion of the training structure of which burn room 200 is a part.

Figure 3:
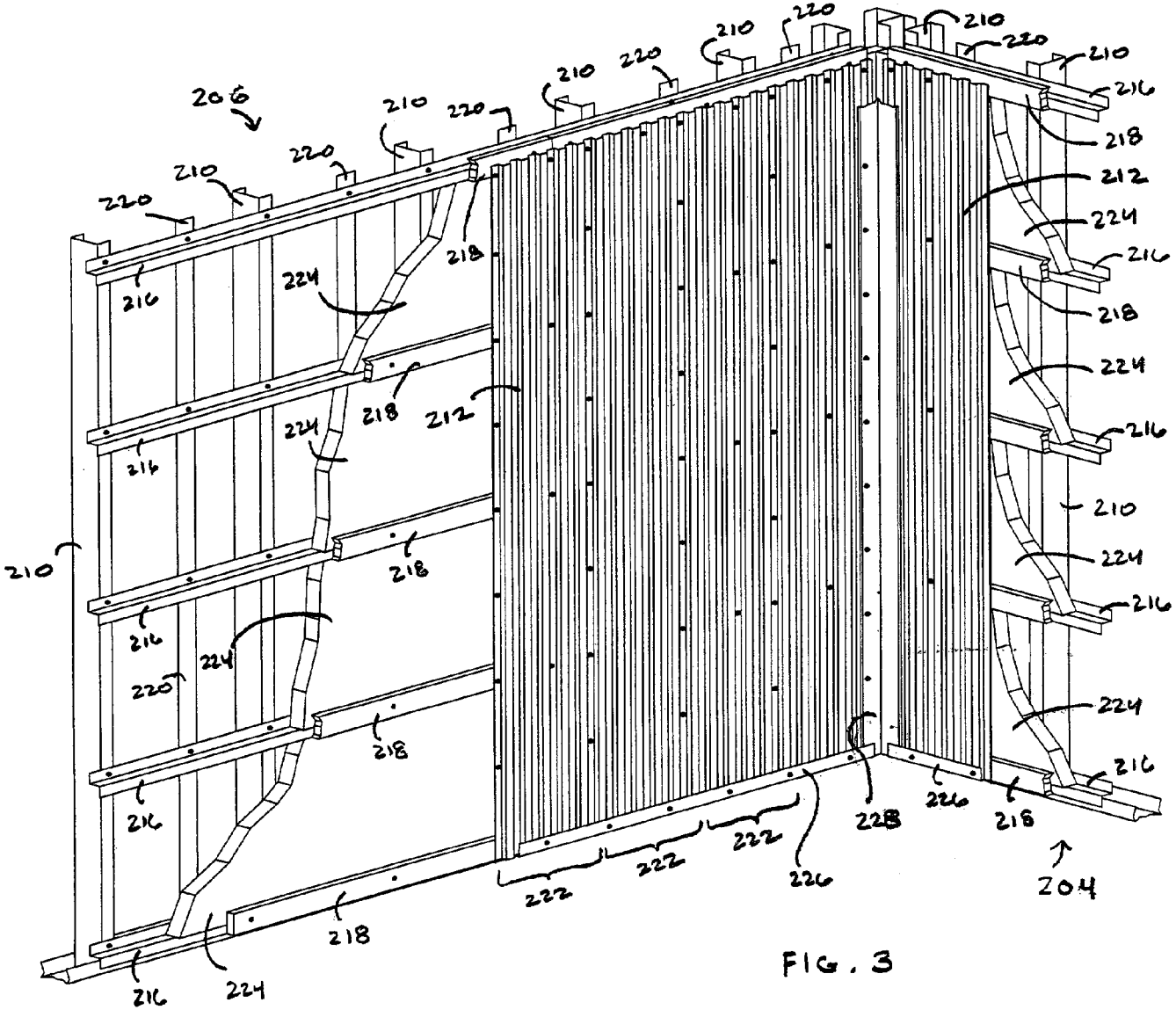
FIG. 3 shows a partially cut-away isometric view of two adjoining walls of a burn room according to one embodiment of the present invention.
Figure 4:
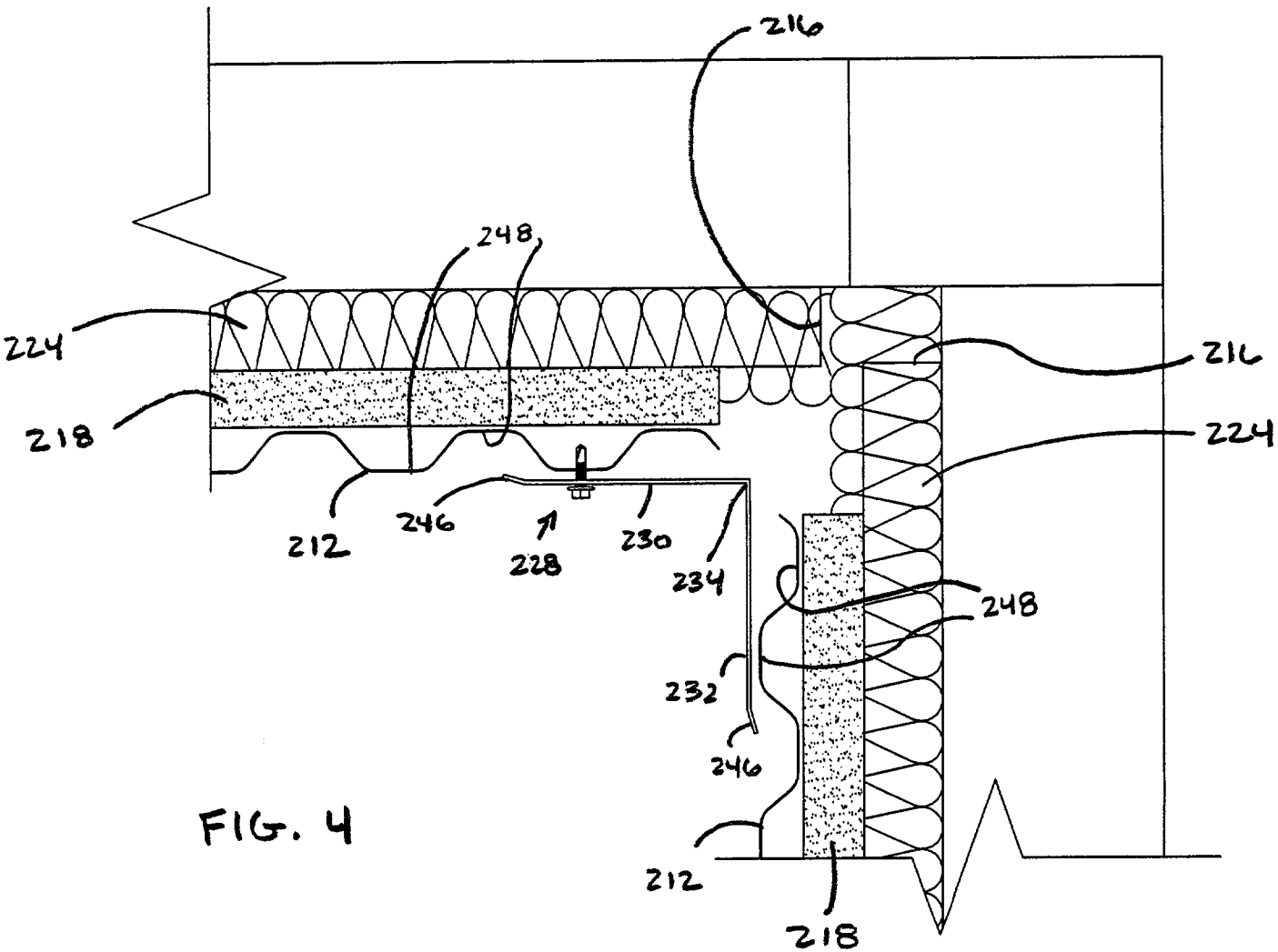
FIG. 4 shows a plan view of the wall corner of the burn room of FIG. 3.

The detailed construction of the walls and insulating system of burn room 200 according to one embodiment of the present invention is shown in FIGS. 3-6. FIG. 3 shows a portion of burn room 200 detailing the construction of side wall 206 where it adjoins back wall 204. For purposes of illustration, we will describe the construction of side wall 206 and the insulation system attached to side wall 206 in detail herein, including their relationship to back wall 204. It should be understood, however, that our discussion is applicable to all of the other walls of burn room 200 as well.

The structural framework of side wall 206 as shown in FIG. 3 is comprised of a plurality of wall studs 210. Wall studs 210, as previously discussed in reference to FIG. 2, are vertically oriented and equally spaced along the length of wall 206. Wall studs 210 are formed from steel in this embodiment.

The insulating system attached to wall 206 (e.g., the wall studs) in this embodiment includes a wall face panel 212, a plurality of face panel mounting brackets 216, a plurality of insulating strips 218, and an insulating layer comprised of a plurality of insulating blanket sections 224. Also provided is a plurality of strap braces 220 disposed between wall studs 210.

Horizontal wall face panel mounting brackets 216, which are equally spaced between the top and bottom of wall 206, are attached to, and run perpendicular to, wall studs 210. Face panel mounting brackets 216 are z-shaped channel members in this embodiment formed from 20 gauge steel. Each z-shaped channel bracket includes an upwardly directed rear leg 236, a downwardly directed front leg 238, and a middle displacement leg 240 connected between the lower end 242 of upwardly directed rear leg 236 and the upper end 244 of downwardly directed front leg 238 (see FIGS. 10-12).

The upwardly directed rear leg 236 of each z-shaped face panel mounting bracket 216 is attached to the plurality of wall studs 210 using conventional fasteners such as, for example, #12×¾ inch hex head self drilling screws. It should be understood that although particular fasteners are identified throughout this discussion, the present invention is not limited to the use of these particular fasteners. In other embodiments of the present invention, for example, other sizes and types of fasteners can be used. Also, although at certain points in this discussion we describe the spacing and location for certain fasteners, the present invention is not necessarily limited to those particular spacings or locations and in other embodiments of the present invention, other locations and spacings are utilized.

Figure 14:
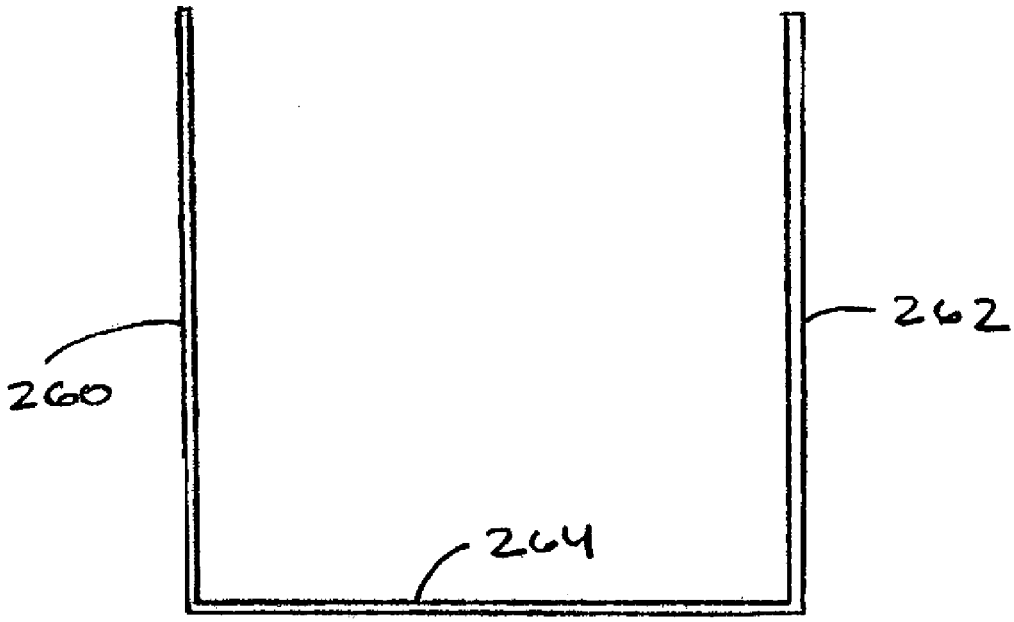
FIG. 14 shows a u-shaped face plate mounting bracket according to an alternative embodiment of the present invention.

In an alternative embodiment, face panel mounting brackets 216 are u-shaped brackets (See FIG. 14). Each u-shaped channel bracket includes an upwardly directed rear leg 260 for attachment to a wall stud 210, an upwardly directed front leg 262 for attachment, either directly or through an insulating strip, to the back side of wall face panel 212, and a middle displacement leg 264 connected between the lower end of upwardly directed rear leg 260 and the lower end of upwardly directed front leg 262.

A thermal blocking strip or insulating strip 218 running the entire length of each bracket member 216 is attached to the downwardly directed front leg 238 of each face panel mounting bracket 216. In other embodiments of the present invention, however, the insulating strips are shorter and only run for a portion of the length of the face panel mounting brackets 216. In other embodiments, a plurality of shorter insulating strips are attached to each face panel mounting bracket 216 at key points as compared to one long continuous insulating strip 218.

Insulating strips 218 are provided to thermally insulate the metal corrugated wall face panel 212 from the metal z-channel mounting brackets 216 and thus from wall studs 210. Insulating strips 218 in this embodiment are made from the same calcium silicate material that is used in the prior art insulating panels 106. This material is sold by the assignee of this application under the brand name Westemp®. The present invention is not limited to the use of this particular insulating material, however, and in other embodiments of the present invention, other insulating materials can be used. In other embodiments, depending on the particular material used for wall face panel 212, no insulating strips are needed between wall face panel 212 and face panel mounting brackets 216.

Each thermal insulating strip 218 is attached to its corresponding bracket 216 at various points along its length using conventional fasteners such as, for example, #8×1⅝ inch phillips wafer head self drilling screws. The maximum distance between screws is no more than 24 inches on center in the embodiment of FIG. 3. In other embodiments, however, the maximum spacing between screws is greater than or less than 24 inches on center.

Attached to the front side of each insulating strip 218 opposite the face panel mounting brackets 216 is wall face panel 212. The back side of wall face panel 212 is attached to each insulating strip 218 using a plurality of face panel mounting fasteners 250 (see FIGS. 10-12). Face panel mounting fastener, as used herein, means a fastener that either attaches a face panel directly to a wall or ceiling (or the structural framework of a wall or ceiling) or attaches a face panel to a face panel mounting bracket, either directly or through an insulating strip.

Face panel mounting fasteners 250 are conventional stainless steel fasteners such as, for example, #12×2 inch stainless steel hex head self drilling screws in one embodiment. In other embodiments, however, other types of fasteners are used including bolts, rivets, screws, pins, etc. . . . . The maximum horizontal distance between fasteners 250 is no more than 6 inches on center in the embodiment of FIG. 3. In other embodiments, however, the maximum spacing between screws is greater than or less than 6 inches on center.

Thus, it can be seen from FIG. 3 that wall face panel 212, when connected to side wall 206, is displaced away from sidewall 206 by face panel mounting brackets 216 and insulting strip 218 in this embodiment. This displacement helps allow corrugated wall face panel 212 to move or float upward and downward in a direction that is parallel to the direction of the corrugations.

Figure 13:
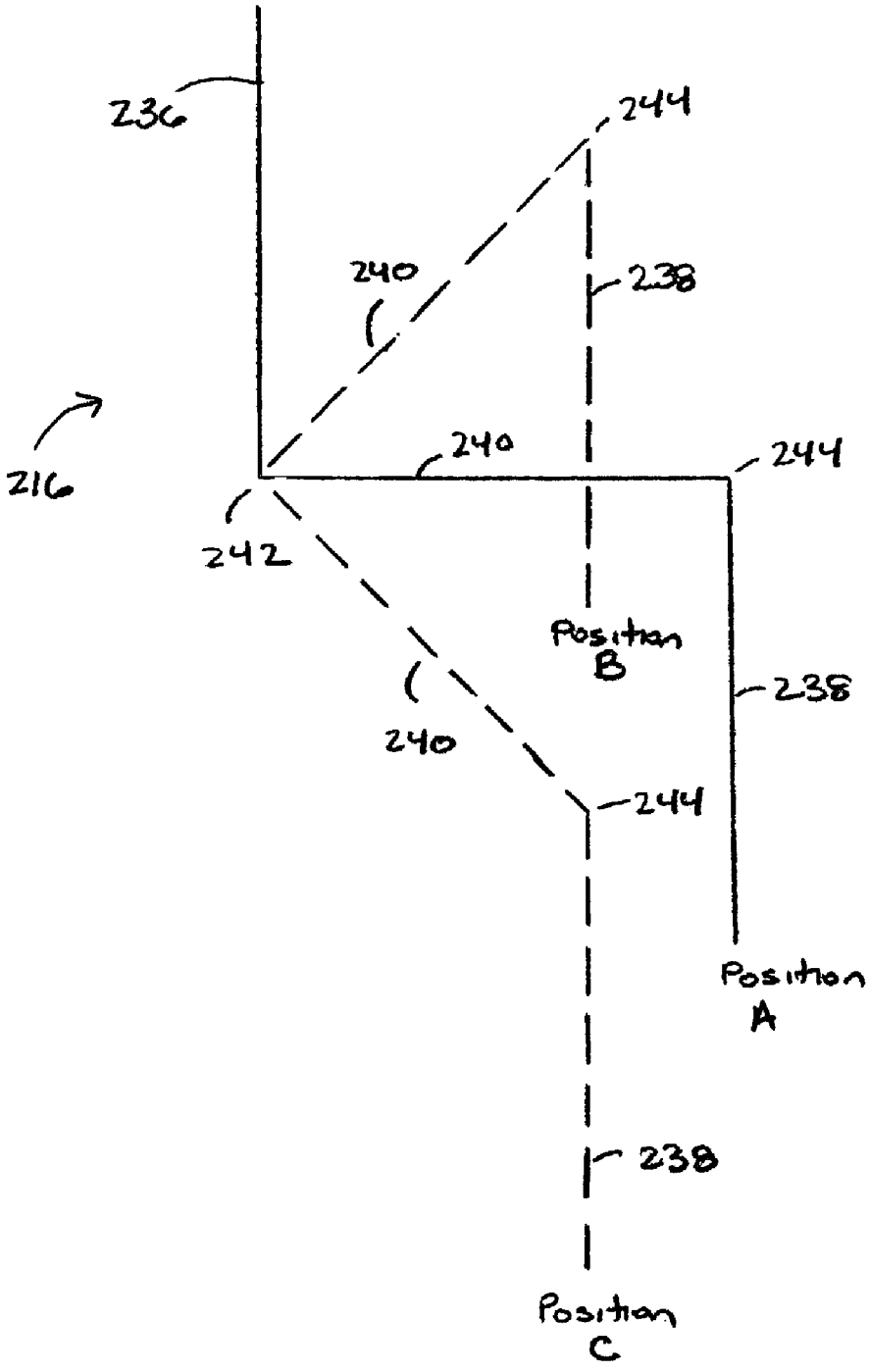
FIG. 13 shows the various positions of a z-shaped face plate mounting bracket according to one embodiment of the present invention.

FIG. 13 shows in more detail what happens to the z-shaped face panel mounting members as wall face panel 212 expands, contracts and moves in response to temperature changes inside of burn room 200. At room temperature, z-shaped face panel mounting members 216 are generally going to be in position A (see FIG. 13) with their middle displacement legs 240 horizontally (or substantially horizontally) oriented. As the temperature in burn room 200 increases, wall face panel 212 begins to expand. As wall face panel 212 expands and begins to move, the middle displacement leg 240 of each face panel mounting bracket 216 attached to wall face panel 212 flexes and changes its angular position. Depending on the direction of expansion of wall face panel 212 in the vertical direction, face panel mounting brackets 216 will assume either position B or position C as shown in dotted lines in FIG. 13. In this way, each wall face panel moves or floats upwards or downwards on the middle legs 240 of face panel mounting brackets 216 in response to temperature changes inside of the burn room.

It should be noted that wall face panel 212 in the embodiment of FIG. 3 is actually comprised of a plurality of smaller panel sections 222 physically connected together along their long or longitudinal edges to completely cover the inside surface of wall 206. Longitudinal, as used herein for a particular face panel, means the direction that is parallel to the direction of the corrugations of that face panel. Each panel section 222 is formed from 24 gauge corrugated stainless steel with the corrugations or ribs 248 running vertical in this embodiment (see FIG. 5).

As previously mentioned, adjoining panel sections 222 are connected along there longitudinal edges to form a single face panel that covers the entire inner surface of wall 206 (or substantially the entire inner surface of wall 206 in an alternative embodiment). More specifically, adjoining face panel sections 222 overlap with each other and are connected to each other at their overlapping seam using conventional fasteners such as, for example, #12×¾ inch hex head self drilling screws. The fasteners are located 2 feet on center and are positioned so as to be located between face panel mounting brackets 216 which are attached to the back side of wall face panel sections 222.

It should also be understood that the present invention is not limited to the use of corrugated face panels. In other embodiments, for example, the face panels are flat or include some other structure configured to absorb expansion and contraction of the face panel due to temperature changes inside of the burn room. Absorption member, as used herein in connection with face panels, means any structure or contour contained on a face panel that has the capability to absorb changes in the size of the face panel due to expansion and contraction of the face panel so as to prevent an appreciable change in the overall dimension of the face panel in either one or more directions. Finally, the present invention is not limited to the corrugation shape and configuration shown in the figures and other corrugation shapes and configurations can be used.

In addition to the components thus far described, a separate layer of insulation is also provided between the back side of wall face panel 212 and wall studs 210 in this embodiment. The insulating layer in this embodiment is comprised of a plurality of insulating blanket sections 224 that are positioned immediately adjacent to the back side of wall face panel 212 and between adjacent spaced apart face panel mounting brackets 216. Each of the insulating blankets in this embodiment is a 2 inch thick ceramic fiber insulating blanket such as the Fiberfrax® Durablanket® S sold by Unifrax Corporation of Niagra Falls, N.Y. In other embodiments of the present invention, however, other types of insulation and/or insulating blankets can be used.

Figure 11:
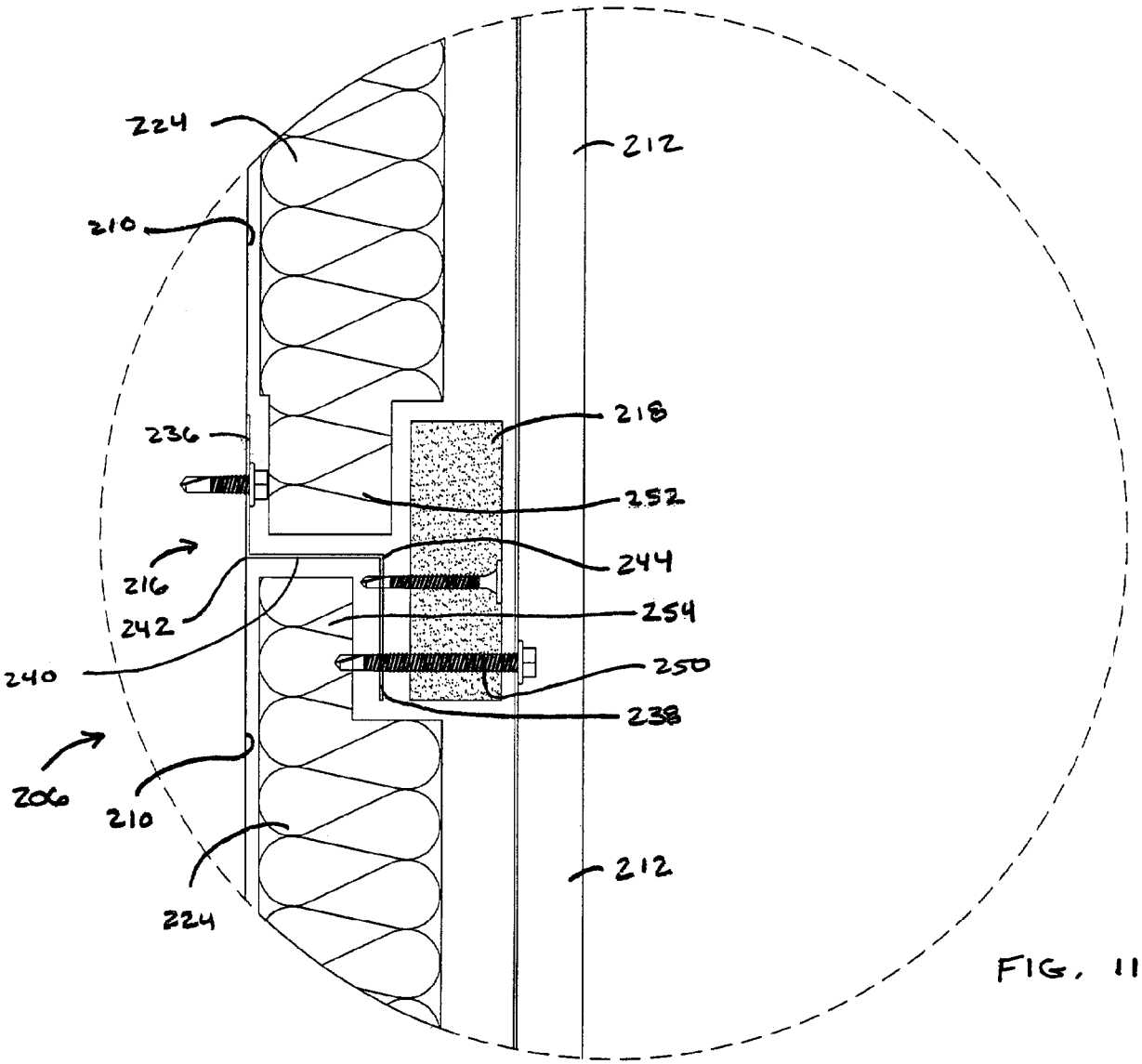
FIG. 11 shows a detailed sectional view of a portion of one of the walls of the burn room shown in FIG. 9.

FIG. 11 shows a detailed sectional view of side wall 206. As shown in this figure, each wall insulating blanket 224 is located immediately behind wall face panel 212 and is disposed between adjacent wall face panel mounting brackets 216. More particularly, the bottom end portion 252 of each insulating blanket 224 is positioned above, and rides on, the horizontal middle displacement leg 240 of each z-shaped channel bracket 216 and is disposed in front of upwardly directed rear leg 236. The top end portion 254 of each insulating blanket 224, likewise is positioned below the horizontal middle displacement leg 240 of the adjacent z-shaped channel mounting bracket 216 and is tucked behind the downwardly directed leg 238 of the adjacent z-shaped channel mounting bracket 216.

In this manner, each insulating blanket is disposed in the channels formed by adjacent pairs of z-shaped channel mounting brackets 216 and the channel mounting brackets help secure and hold insulating blankets 224 in place between the back side of wall face panel 212 and wall studs 210. A similar construction is present in the insulating system of ceiling 300.

Figure 10:
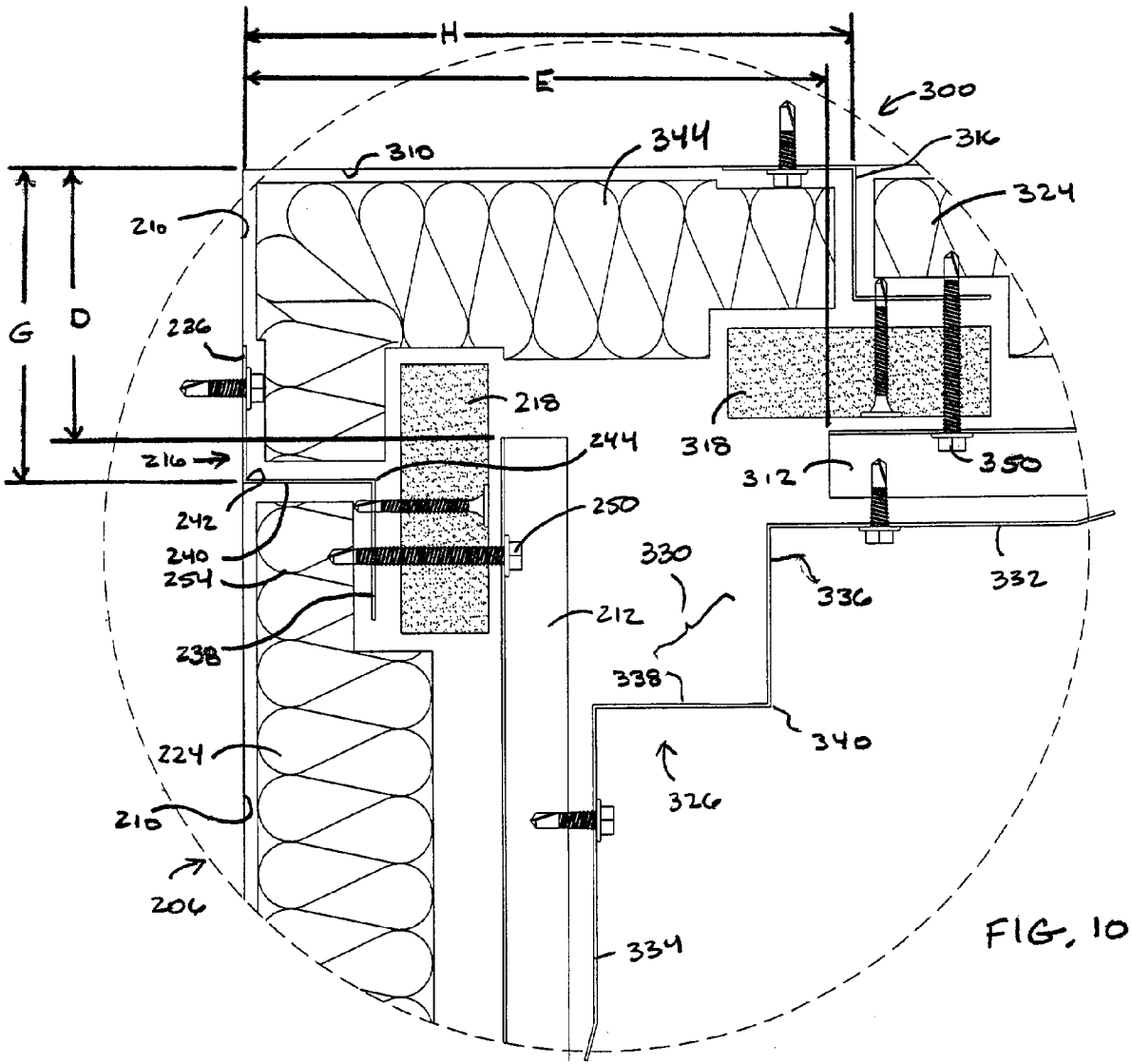
FIG. 10 shows a detailed sectional view of one of the top corners of the burn room shown in FIG. 9.
Figure 12:
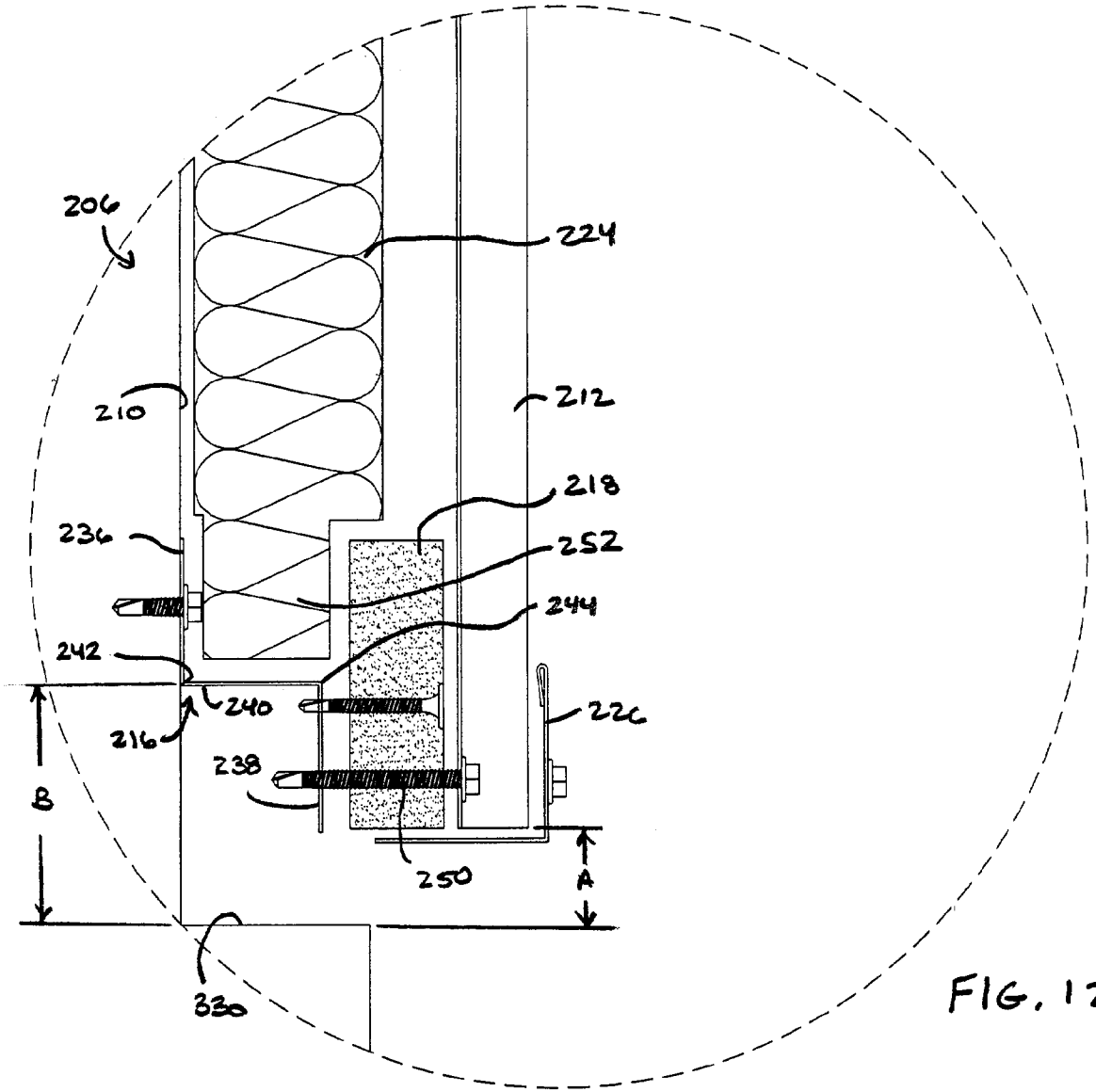
FIG. 12 shows a detailed sectional view of one of the bottom corners of the burn room shown in FIG. 9.

Another feature that can be noted from FIGS. 10-12 is that the face panel mounting fasteners 250, which attach wall face panel 212 to face panel mounting brackets 216 (through insulating strips 218 in this embodiment) never penetrate through insulating blankets 224. Rather, mounting screws 250 only penetrate slightly into insulating blankets 224 and an insulating blanket 224 is disposed between the end of each wall face panel mounting fastener 250 and side wall 206 (or the structural framework of side wall 206) in this embodiment. In this way, insulating blankets 224 and the insulating system of the present invention provide a complete thermal block of the heat generated inside of burn room 200 to prevent such heat from reaching the structural framework of burn room 200.

Strap bracing strips 220 are provided between each pair of wall studs to help prevent the insulating layer from bowing out between adjacent wall studs 210. Each strap brace 220 is formed from steel and is attached to the back side of the face panel mounting brackets using conventional fasteners such as, for example, #12×¾ inch hex head self drilling screws. In other embodiments, no strap braces are used.

To finish off wall 206, a right angle wall bottom trim piece or member 226 is attached to the bottom of wall face panel 212. Trim piece 226 is formed from 20 gauge stainless steel and is attached to wall face panel 212 using conventional fasteners such as, for example, #12×¾ inch hex head self drilling screws located every 9 inches on center along the length of trim piece 226.

As can be seen in more detail in FIG. 12, bottom trim piece 226 is a right angle trim piece and wraps around the bottom of corrugated wall face panel 212. To provide adequate room for downward expansion of wall face panel 212 in this embodiment, a minimum clearance distance "A" is provided between the bottom edge of face panel 212 and the floor (or footing) 330 of burn room 200. In this embodiment, the minimum clearance distance is at least 1 inch. It should be noted that in other embodiments of the present invention, no minimum clearance distance is provided or a minimum clearance distance of greater than or less than 1 inch is provided. Finally, the distance "B" between the middle horizontal leg 240 of the lower most mounting bracket 216 and floor 330 is approximately 2½ inches in this embodiment and is different in other embodiments.

In addition to bottom trim piece 226, a right angle wall corner trim piece 228 covers the seam or joint between adjoining side wall 206 and back wall 204. Corner trim piece 228 includes two leg members 230 and 232 that are at right angles to each other and meet at corner 234 of corner trim piece 228 (see FIG. 4). The outer edges 246 of each leg 230 and 232 are bent slightly inward toward the wall face panels 212 to provide better sealing of the corner against any flames and heat that might be present in the burn room and also to help prevent the outer edges 246 of corner trim piece 228 from snagging clothing.

Corner trim piece 228 is formed from 16 gauge stainless steel and is attached to the edge of wall panel 212 of side wall 206 using conventional fasteners such as, for example, #12×¾ inch hex head self drilling screws positioned 9 inches on center along the length of corner trim piece 228. It should be noted at this time that corner trim piece 228 is only attached to wall face panel 212 of side wall 206 and is not attached to wall face panel 212 of back wall 204 (see FIG. 4). The reason for this is to allow wall face panel 212 of side wall 206 to move or float independently of wall face panel 212 of back wall 204 as the temperature in burn room 200 rises and falls.

Thus, it can be seen that wall face panel 212 attached to side wall 206 is not physically attached to wall face panel 212 of adjoining back wall 204 other than indirectly through fixed walls 206 and 204 (e.g, via the structural framework of those two walls) and each panel is free to move independently of the other panel in response to changes in temperature inside of burn room 200. Face panels attached in this manner are referred to herein as floating face panels A face panel is a floating face panel, as that term is used herein, when the face panel is physically attached to only one wall (or the structural framework of only one wall) and not to any other walls, wall panels or the floor (other than indirectly through the fixed structural framework of the walls) of the burn room and the face panel can move or float in response to temperature changes inside of the burn room.

Figure 5:
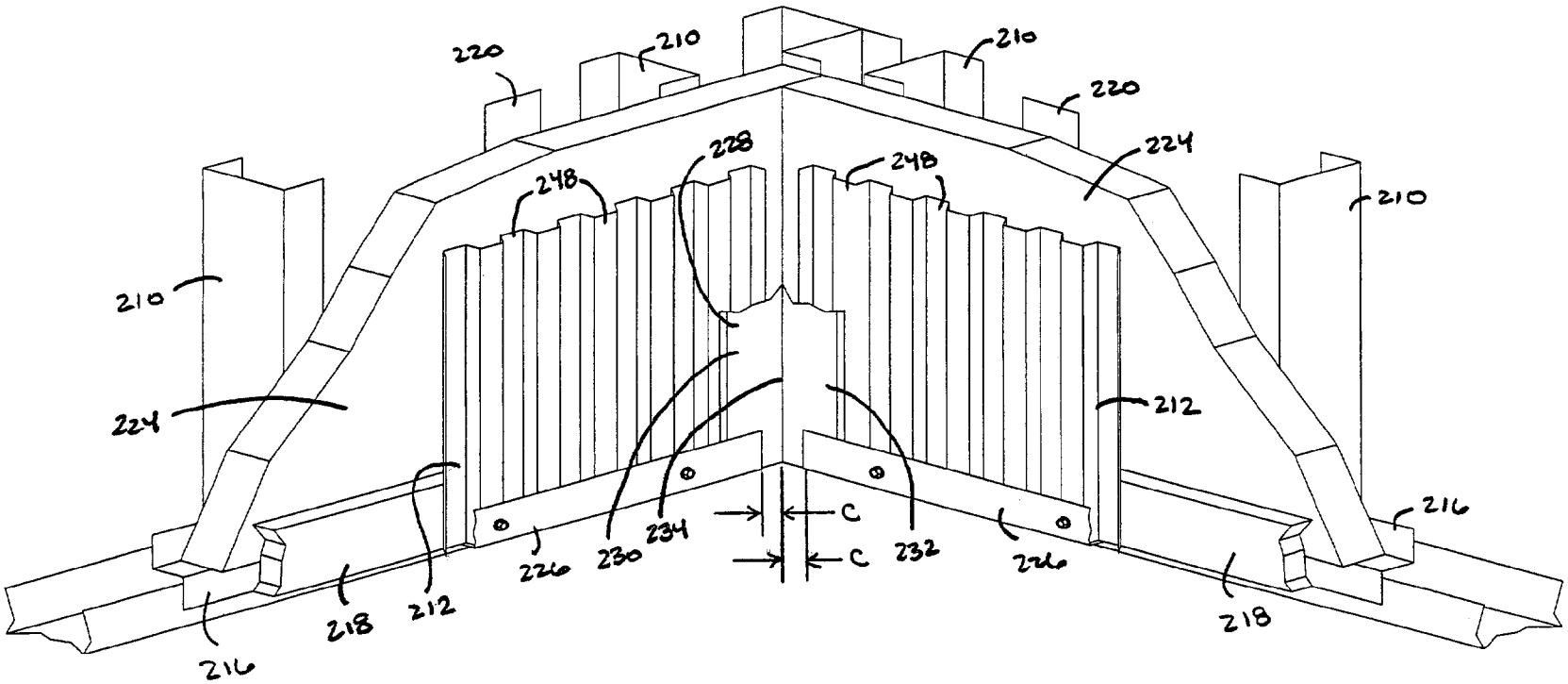
FIG. 5 shows a partially cut-away isometric detailed view of the lower corner between the adjoining walls shown in FIG. 3.

FIG. 5 shows in detail the construction of the bottom corner between side wall 206 and back wall 204 in the embodiment of FIG. 3. As can be seen in FIG. 5, the bottom trim pieces 226 of walls 206 and 204 meet in the corner and overlap corner trim piece 228. In other embodiments, corner trim piece 228 overlaps bottom trim pieces 226.

A minimum clearance distance "C" is provided between the end of each bottom trim piece 226 and corner 234 of corner trim piece 228. The reason for providing a minimum clearance distance is to allow for expansion and contraction of the wall face panels 212 that result from increasing and decreasing temperatures inside of burn room 200. In the embodiment shown in FIG. 5, for example, the minimum clearance distance "C" is at least 1 inch. In other embodiments, however, a minimum clearance distance is not provided or is greater than or less than 1 inch.

It should be noted that although bottom trim piece 226 of back wall 204 is attached to wall face panel 212 of back wall 204, bottom panel trim piece 226 of back wall 204 is not fastened to corner trim piece 228 in this embodiment. The reason for not attaching bottom trim piece 226 of back wall 204 to corner trim piece 228 once again is to allow wall panel 212 on side wall 206 to move or float independently of wall panel 212 of adjoining back wall 204 as the wall panels expand and contract due to temperature increases and decreases inside of burn room 200.

Figure 6:
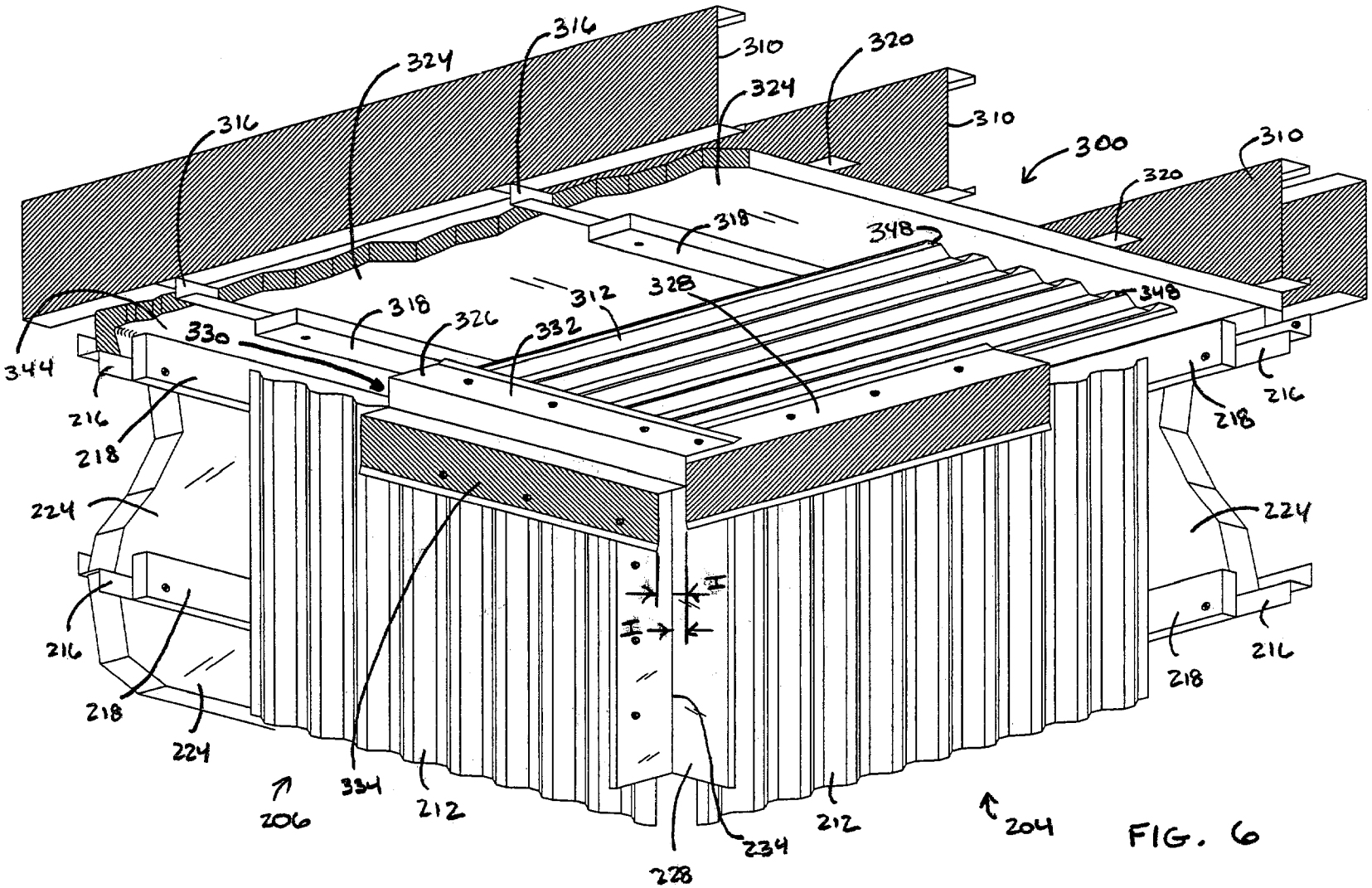
FIG. 6 shows a partially cut-away isometric view of the intersection between two adjoining walls and the ceiling of a burn room according to one embodiment of the present invention.
Figure 7:
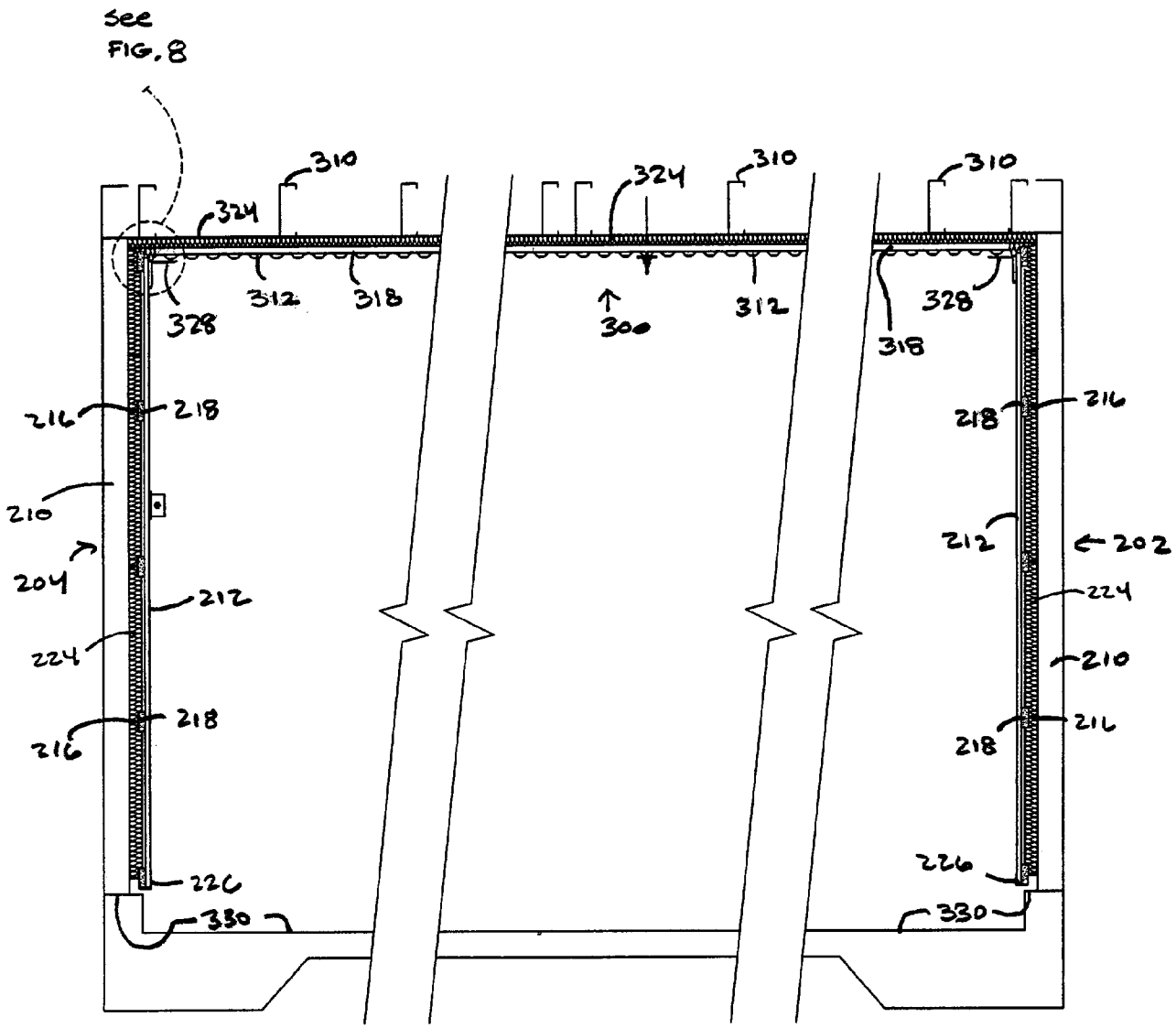
FIG. 7 is a sectional side view showing the side walls and the ceiling of a burn room according to one embodiment of the present invention.

FIG. 6 shows the detailed construction of the ceiling 300 of burn room 200 and the insulation system of the present invention attached to ceiling 300. The structural framework of ceiling 300 as shown in the embodiment of FIG. 6 is comprised of a plurality of ceiling joists 310. Ceiling joists 310 are horizontally oriented and are equally spaced apart across ceiling 300. Ceiling joists 310 in this embodiment, like wall studs 210, form a part of the structural framework of burn room 200 and are typically formed from galvanized steel.

The insulating system attached to ceiling 300 includes a ceiling face panel 312, a plurality of ceiling face panel mounting brackets 316, a plurality of insulating strips 318, and an insulating layer comprised of a plurality of insulating blanket sections 324. In addition, a plurality of strap braces 320 are provided between ceiling joists 310. Note that the construction of the insulating system of ceiling 300 is very similar to the construction of the insulating system of the walls of burn room 200 in this embodiment.

It should be noted that it is not a requirement of the present invention that the entire burn room be insulated using the insulating system of the present invention. In one embodiment of the present invention, for example, only the walls of the burn room incorporate the insulating system of the present invention. The ceiling in this embodiment utilizes prior art insulation systems such as is shown in FIG. 1. In other embodiments, only the ceiling utilizes the insulating system of the present invention and the walls are insulated using other insulating systems.

Horizontal ceiling face panel mounting brackets 316, which are equally spaced apart between the sidewalls of burn room 200 in this embodiment, are attached to the underside of ceiling joists 310 and run perpendicular to ceiling joists 310. Ceiling face panel mounting brackets 316 are also z-shaped channel brackets in this embodiment, although other types of face panel mounting brackets can be used, and are formed from 20 gauge steel. One leg (upper leg) of each mounting bracket 316 is attached to the underside of each ceiling joist 310 using conventional fasteners such as, for example, #12×¾ inch hex head self drilling screws.

The other leg (the lower leg or leg opposite the ceiling joists) of each face panel mounting bracket 316 is attached to an insulating strip 318 that runs the entire length of each bracket 316. In other embodiments of the present invention, insulating strips only run for a portion of the length of the mounting brackets 316. In yet other embodiments, a plurality of shorter insulating strips are attached to each face panel mounting bracket 316 at key points as compared to one long insulating strip 318.

Each insulating strip 318 is attached to its corresponding bracket 316 at various points along its length using conventional fasteners such as, for example, #8×1⅝ inch phillips wafer head self drilling screws. The maximum distance between screws is no more than 24 inches on center in the embodiment of FIG. 6. In other embodiments, however, the maximum spacing between screws is greater than or less than 24 inches on center.

Attached to the bottom or underside of each thermal insulating strip 318 opposite the face panel mounting brackets 316 is ceiling face panel 312. The back side of ceiling face panel 312 is attached to each insulating strip 318 using conventional stainless steel fasteners such as, for example, #12×2 inch stainless steel hex head self drilling screws. The maximum horizontal distance between screws is no more than 6 inches on center in the embodiment of FIG. 6. In other embodiments, however, the maximum spacing between screws is greater than or less than 6 inches on center.

It should be noted that ceiling face panel 312 in the embodiment of FIG. 6, like wall face panel 212, is actually comprised of a plurality of smaller panel sections physically connected together along their longitudinal edges to completely cover the inside surface of ceiling 300. It should also be noted that the individual corrugations or ribs 348 of ceiling face panel 312 run longitudinally between front and back walls 202 and 204 of burn room 200 in this embodiment. In an alternative embodiment, the corrugations run longitudinally between the side walls 206 and 208 of burn room 200.

Each individual panel section of ceiling face panel 312 is formed from 24 gauge corrugated stainless steel. Individual adjoining panel sections of ceiling face panel 312 are connected along there long edges to form a single face panel that covers the entire inner surface of ceiling 300 (or substantially the entire inner surface of ceiling 300 in an alternative embodiment) in the same manner as are the individual panel sections 222 that make up wall face panels 212.

In addition to the components thus far described, a separate layer of insulation is also provided between the upper surface of ceiling face panel 312 and the underside of ceiling joists 310 in this embodiment. The ceiling insulating layer in this embodiment is also comprised of a plurality of insulating blanket sections 324 that are similar to the insulating blanket sections 224 that comprise wall insulation layer 214. Insulating blanket sections 324 are positioned immediately adjacent the back side of ceiling face panel 312 and between each adjacent face panel mounting brackets 316 in this embodiment.

Strap bracing strips 320 are provided between each pair of adjacent ceiling joists to help prevent the ceiling insulating layer from bowing upward between adjacent ceiling joists 310. Each strap brace 320 is formed from steel and is attached to the back side of the face panel mounting brackets 316 using conventional fasteners such as, for example, #12×¾ inch hex head self drilling screws. In other embodiments, no strap braces are used.

In addition to the insulating blanket sections 324 disposed between adjacent mounting brackets 316, a width of insulation wrap 344 is stuffed into the corner between the top of side wall 206 and ceiling 300 (see FIG. 10). Insulation wrap 344 is typically stuffed into this space prior to installation of the adjacent thermal blocking strips 218 and 318. Likewise, a similar width of insulation 346 is stuffed into the corner between the top of back wall 204 and ceiling 300 (see FIG. 8). Insulation wrap 346 is typically stuffed into this space after wall and ceiling face panels 212 and 312 are in place.

Figure 8:
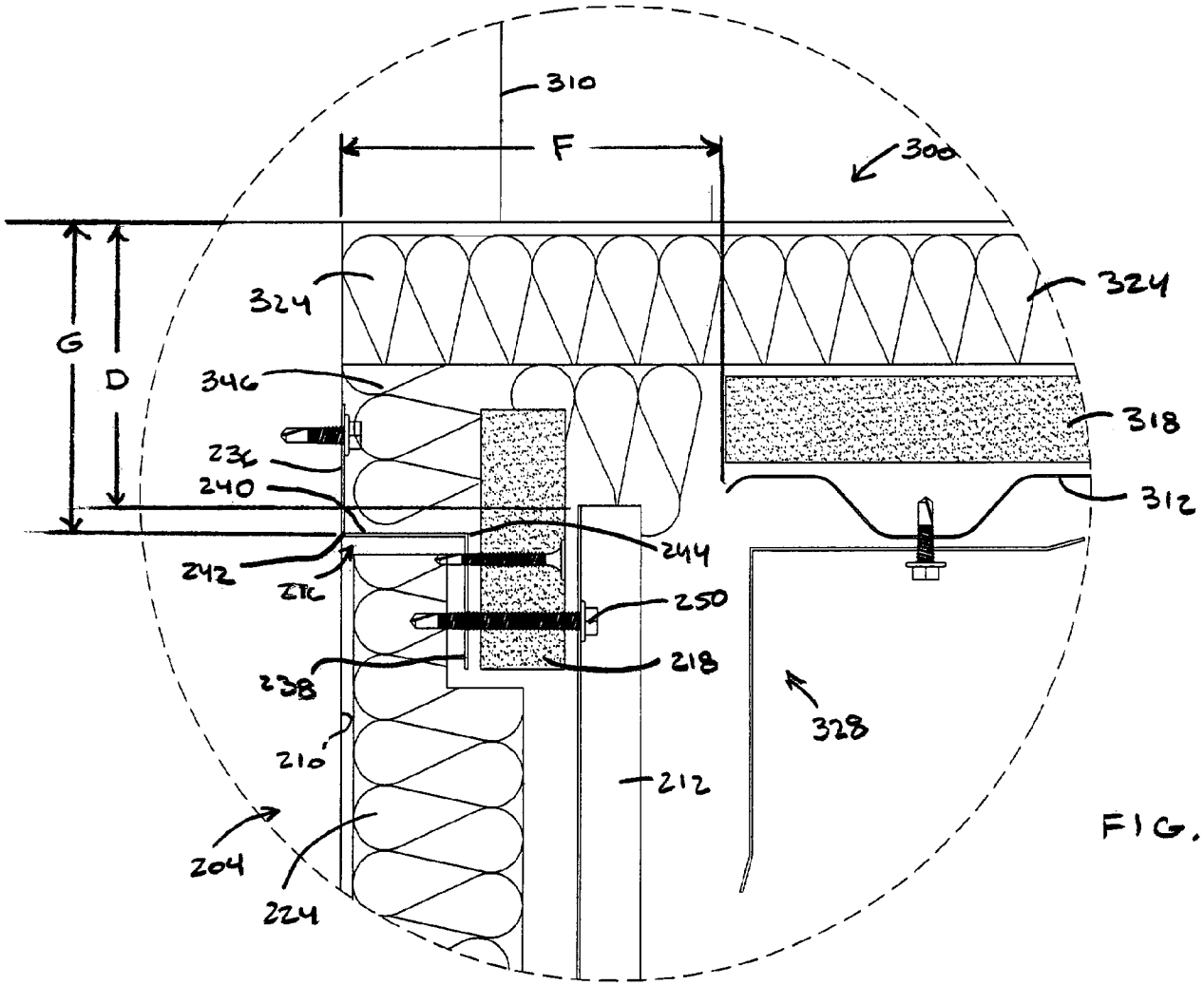
FIG. 8 shows a detailed sectional view of one of the top corners of the burn room shown in FIG. 7.
Figure 9:
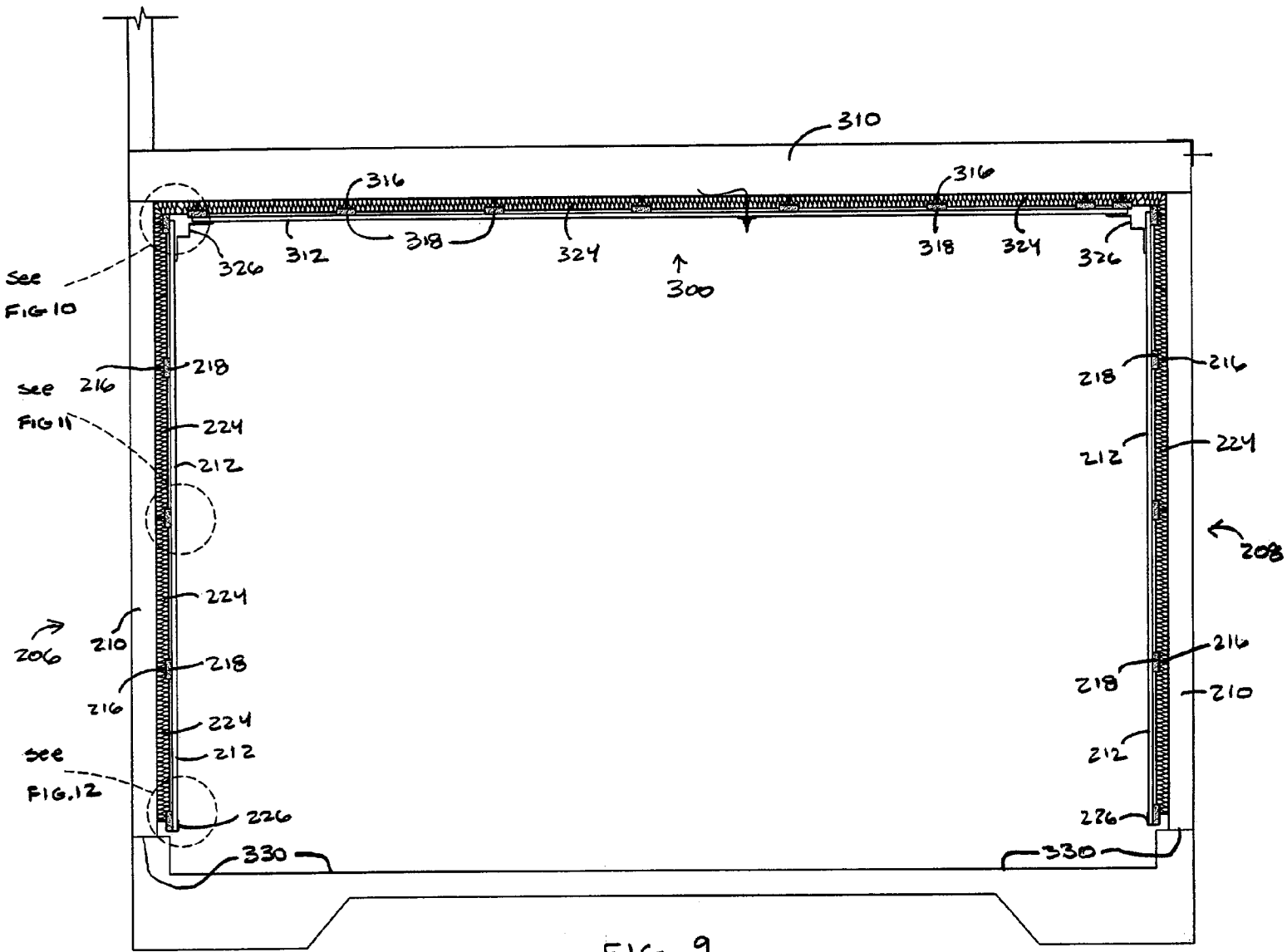
FIG. 9 is a sectional side view showing the back and front walls and the ceiling of a burn room according to one embodiment of the present invention.

As shown in FIGS. 8 and 10, to provide for proper upward expansion of the various wall face panels 212 during heating, a minimum clearance distance "D" is provided between the top edge of wall face panel 212 and the underside of ceiling joists 310. Likewise, to provide for proper outward expansion of ceiling face panel 312 in response to temperature changes inside of burn room 200, a minimum clearance distance "E" is provided between the end of ceiling face panel 312 and the wall studs 210 of side wall 206 (see FIG. 10), and a minimum clearance distance "F" is provided between the longitudinal edge of ceiling face panel 312 and the wall studs 210 of back wall 204 (see FIG. 8). In the embodiment of FIGS. 8 and 10, for example, the minimum clearance distance "D" is 3 inches, the minimum clearance distance "E" is 6 3/16 inches and the minimum clearance distance "F" is 4½ inches. In other embodiments of the present invention, no minimum clearance distances are provided or minimum clearance distances greater than or less than those specified above are provided.

In addition to the minimum clearance distances discussed above, the distance "G" between the horizontal leg 240 of the uppermost mounting bracket 216 of walls 204 and 206 and the underside of the ceiling joists 310 is approximately 3½ inches in the embodiments of the present invention shown in FIGS. 8 and 10. Similarly, the distance "H" between the horizontal leg 240 of the outer most mounting bracket 316 and the wall studs of side wall 206 is approximately 7 inches in the embodiment shown in FIG. 10. In other embodiments, however, these distances can be different.

Various ceiling corner trim pieces are provided to finish off and seal the intersections between ceiling 300 and the various walls that make up burn room 200. For example, at the intersection between ceiling 300 and side wall 206, a box corner trim piece 326 is provided. Box corner trim piece 326 is formed from 16 gauge stainless steel and is attached to both the underside of ceiling face panel 312 and to the outside of wall face panel 212 of side wall 206 using conventional fasteners such as, for example, #12×¾ inch hex head self drilling screws located every 9 inches on center along the length of box corner trim piece 326. These screws generally penetrate through the corrugated stainless steel panels to a depth that is less than the depth of the corrugations.

Box corner trim piece 326, which when viewed in cross section, has a staircase or step profile (see FIG. 10), includes a right angle center flex member 330 and a pair of outwardly directed legs 332 and 334 that are connected at right angles to flex member 330. One of the outwardly directed legs 332 is attached to the underside of ceiling face panel 312 while the other outwardly directed leg 334 is attached to wall face panel 212 of side wall 206. The outer edges of each leg 332 and 334 are bent slightly inward toward the face panels to provide better sealing of the corner against any flames and heat that might be present in the burn room.

Box corner trim piece 326 is provided at this location to allow for movement and expansion of both ceiling face panel 312 and wall face panel 212 of side wall 206 in the longitudinal direction as the temperature in the burn room rises and falls. For example, as the temperature in burn room 200 rises, wall panel 212 and ceiling panel 312 will expand. This expansion will in turn cause ceiling panel 312 and wall panel 212 to move or rock or float towards and away from each other on their respective z-shaped channel mounting brackets as the temperature inside of the burn room changes. This movement is absorbed by flex member 330 of corner trim piece 326.

More specifically, center flex member 330 includes a flex joint 340 and a pair of flex leg members 336 and 338. At room temperature flex joint 330 is a right angle joint (or substantially a right angle joint) and flex members 336 and 338 are at right angles (or at substantially right angles) to outer leg members 332 and 334 respectively. As wall face panel 212 and ceiling face panel 312 move in their longitudinal directions in response to temperature changes inside of burn room 200, various portions of flex member 330 begin to flex and move permitting face panels 212 and 312 to move in their longitudinal directions as the temperature inside of the burn room rises and falls. It should be noted that during flexing of flex member 330, the angle of flex joint 330 changes as do the angles between flex legs 336 and 332 and between 338 and 334.

A second right angle ceiling corner trim piece 328 is located at the intersection between ceiling 300 and back wall 204. Corner trim piece 328 is a simple right angle corner trim piece that is formed from 16 gauge stainless steel. Right angle corner trim piece 328 is attached to the underside of ceiling face panel 312 using conventional fasteners such as, for example, #12×¾ inch hex head self drilling screws located every 9 inches on center along the length of corner trim piece 328. The outer edges of each right angle leg of corner trim piece 328 are bent slightly inward toward the face panels to provide better sealing of the corner against any flames and heat that might be present in the burn room.

It should be noted that right angle corner trim piece 328 is not attached to wall face panel 212 of back wall 204 in this embodiment (see FIG. 8). The reason for this is to allow wall face panel 212 of back wall 204 to move or float independently of ceiling face panel 312 as the temperature in burn room 200 rises and falls. Thus, it can be seen that wall face panel 212 attached to back wall 204 is not physically attached to ceiling face panel 312 other than indirectly through fixed back wall 204 and fixed ceiling 300 (e.g, via the fixed structural framework of the wall and the ceiling) and each panel is free to move independently of the other panel in response to changes in temperature inside of burn room 200.

FIG. 6 shows in detail the construction of the top corner between side wall 206, back wall 204 and ceiling 300. As can be seen in FIG. 6, ceiling corner trim pieces 326 and 328 meet in the corner and overlap wall corner trim piece 228. However a minimum clearance distance "I" is provided between the ends of corner trim pieces 326 and 328 respectively and corner 234 of wall corner piece 228. In the embodiment shown in FIG. 6, for example, the minimum clearance distance "I" is at least 1 inch. In other embodiments, however, a minimum clearance distance is not provided or is greater than or less than 1 inch.

Also, it should be noted that although the ceiling corner trim pieces 326 and 328 are attached to their respective wall and ceiling face panels 212 and 312 using conventional fasteners as described above, ceiling corner trim pieces 326 and 328 are not fastened to wall corner trim piece 228 in this embodiment. The reason for providing minimum clearance distance "I" and for not attaching ceiling corner trim pieces 326 and 328 to wall corner trim piece 228 is to allow for expansion and contraction of the wall face panels 212 and ceiling face panel 312 that result from increasing and decreasing temperatures inside of burn room 200.

Finally, it should be noted that face panel mounting fasteners 350, which attach ceiling face panel 312 to face panel mounting brackets 316, never penetrate through insulating blankets 324. Rather, face panel mounting screws 350 only penetrate slightly into insulating blankets 324 and an insulating blanket 324 is disposed between the end of each ceiling face panel mounting fastener 350 and ceiling 300 (or the structural framework of ceiling 300) in this embodiment. In this way, insulating blankets 324, like insulating blankets 224, provide a complete thermal block of the heat generated inside of burn room 300 to prevent such heat from reaching the structural framework of burn room 200.

Numerous modifications may be made to the present invention which still fall within the intended scope hereof. Thus, it should be apparent that there has been provided in accordance with the present invention a live fire burn room and insulating system for a live fire burn room that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room;

a first layer of insulation disposed between the first wall face panel and the first wall;

a ceiling face panel attached to the ceiling, wherein the ceiling face panel is exposed to the inside of the burn room;

a ceiling layer of insulation disposed between the ceiling face panel and the ceiling; and a corner trim member attached to the first wall face panel and the ceiling face panel, wherein the corner trim member flexes to allow the first wall face panel and the ceiling face panel to move in response to temperature changes inside of the burn room.

2. The apparatus of claim 1 wherein the first wall face panel covers substantially the entire first wall and is a floating wall face panel.

3. The apparatus of claim 1 wherein the first wall face panel is attached to the first wall in a manner that allows the first wall face panel to move in response to temperature changes inside of the burn room.

4. The apparatus of claim 1 further including a plurality of face panel mounting fasteners attaching the first wall face panel to the first wall, wherein the first layer of insulation is disposed between each face panel mounting fastener and the first wall.

5. The apparatus of claim 4 wherein each of the face panel mounting fasteners has an end disposed between the first wall face panel and the first wall, and further wherein the first layer of insulation is disposed between the end of each face panel mounting fastener and the first wall.

6. The apparatus of claim 5 wherein the first wall includes a plurality of wall studs, and further wherein the first layer of insulation is disposed between the end of each face panel mounting fastener and each of the wall studs.

7. The apparatus of claim 1 wherein the first wall face panel and the ceiling face panel are configured inside of the burn room to move independently of each other as the temperature inside of the burn room rises and falls.

8. The apparatus of claim 1 wherein the first wall face panel is attached to the ceiling face panel in a manner that allows the first wall face panel and the ceiling face panel to each move as the temperature inside of the burn room changes.

9. The apparatus of claim 1 further including a plurality of spaced apart face panel mounting brackets connecting the first wall face panel to the first wall.

10. The apparatus of claim 9 further including an insulating strip disposed between each face panel mounting bracket and the first wall face panel.

11. The apparatus of claim 9 wherein each of the face panel mounting brackets is a z-shaped mounting bracket.

12. The apparatus of claim 9 wherein each of the face panel mounting brackets displaces the first wall face panel away from the first wall.

13. The apparatus of claim 9 wherein each of the face panel mounting brackets includes a flex member that flexes to allow the first wall face panel to move as the temperature inside of the burn room changes.

14. The apparatus of claim 9 wherein each of the face panel mounting brackets includes a displacement member disposed between the first wall face panel and the first wall, wherein the angle of orientation of the displacement member changes as the first wall face panel moves in response to changes in temperature inside of the burn room.

15. The apparatus of claim 9 further including a plurality of face panel mounting fasteners attaching the first wall face panel to the plurality of face panel mounting brackets, wherein the first layer of insulation is disposed between each face panel mounting fastener and the first wall.

16. The apparatus of claim 15 wherein each of the face panel mounting fasteners has an end disposed between the first wall face panel and the first wall, and further wherein the first layer of insulation is disposed between the end of each face panel mounting fastener and the first wall.

17. The apparatus of claim 16 wherein the first wall includes a plurality of wall studs, and further wherein the first layer of insulation is disposed between the end of each face panel mounting fastener and each of the wall studs.

18. The apparatus of claim 9 wherein the first layer of insulation is comprised of at least one insulating blanket disposed between adjacent spaced apart face panel mounting brackets.

19. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room;

a first layer of insulation disposed between the first wall face panel and the first wall;

a ceiling face panel attached to the ceiling, wherein the ceiling face panel is exposed to the inside of the burn room;

a ceiling layer of insulation disposed between the ceiling face panel and the ceiling; and a corner trim member attached between the first wall face panel and the ceiling face panel, wherein the corner trim member includes at least one flex joint that allows the first wall face panel and the ceiling face panel to move as the temperature inside of the burn room changes.

20. The apparatus of claim 19 wherein the first wall face panel covers substantially the entire first wall and is a floating wall face panel.

21. The apparatus of claim 19 wherein the first wall face panel is attached to the first wall in a manner that allows the first wall face panel to move in response to temperature changes inside of the burn room.

22. The apparatus of claim 19 further including a plurality of face panel mounting fasteners attaching the first wall face panel to the first wall, wherein the first layer of insulation is disposed between each face panel mounting fastener and the first wall.

23. The apparatus of claim 22 wherein each of the face panel mounting fasteners has an end disposed between the first wall face panel and the first wall, and further wherein the first layer of insulation is disposed between the end of each face panel mounting fastener and the first wall.

24. The apparatus of claim 23 wherein the first wall includes a plurality of wall studs, and further wherein the first layer of insulation is disposed between the end of each face panel mounting fastener and each of the wall studs.

25. The apparatus of claim 19 wherein the first wall face panel and the ceiling face panel are configured inside of the burn room to move independently of each other as the temperature inside of the burn room rises and falls.

26. The apparatus of claim 19 wherein the first wall face panel is attached to the ceiling face panel in a manner that allows the first wall face panel and the ceiling face panel to each move as the temperature inside of the burn room changes.

27. The apparatus of claim 19 further including a plurality of spaced apart face panel mounting brackets connecting the first wall face panel to the first wall.

28. The apparatus of claim 27 further including an insulating strip disposed between each face panel mounting bracket and the first wall face panel.

29. The apparatus of claim 27 wherein each of the face panel mounting brackets is a z-shaped mounting bracket.

30. The apparatus of claim 27 wherein each of the face panel mounting brackets displaces the first wall face panel away from the first wall.

31. The apparatus of claim 27 wherein each of the face panel mounting brackets includes a flex member that flexes to allow the first wall face panel to move as the temperature inside of the burn room changes.

32. The apparatus of claim 27 wherein each of the face panel mounting brackets includes a displacement member disposed between the first wall face panel and the first wall, wherein the angle of orientation of the displacement member changes as the first wall face panel moves in response to changes in temperature inside of the burn room.

33. The apparatus of claim 27 further including a plurality of face panel mounting fasteners attaching the first wall face panel to the plurality of face panel mounting brackets, wherein the first layer of insulation is disposed between each face panel mounting fastener and the first wall.

34. The apparatus of claim 33 wherein each of the face panel mounting fasteners has an end disposed between the first wall face panel and the first wall, and further wherein the first layer of insulation is disposed between the end of each face panel mounting fastener and the first wall.

35. The apparatus of claim 34 wherein the first wall includes a plurality of wall studs, and further wherein the first layer of insulation is disposed between the end of each face panel mounting fastener and each of the wall studs.

36. The apparatus of claim 27 wherein the first layer of insulation is comprised of at least one insulating blanket disposed between adjacent spaced apart face panel mounting brackets.

37. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room;

a first layer of insulation disposed between the first wall face panel and the first wall; and a plurality of spaced apart face panel mounting members disposed between the first wall face panel and the first wall, wherein each of the face panel mounting members includes a flex member that allows the first wall face panel to move as the temperature inside of the burn room changes.

38. The apparatus of claim 37 wherein the first wall face panel covers substantially the entire first wall and is a floating wall face panel.

39. The apparatus of claim 37 further including an insulating strip disposed between each face panel mounting member and the first wall face panel.

40. The apparatus of claim 37 wherein each of the face panel mounting members is a z-shaped mounting member.

41. The apparatus of claim 37 wherein each of the face panel mounting members displaces the first wall face panel away from the first wall.

42. The apparatus of claim 37 further including a plurality of face panel mounting fasteners attaching the first wall face panel to the plurality of face panel mounting members, wherein the first layer of insulation is disposed between each face panel mounting fastener and the first wall.

43. The apparatus of claim 42 wherein each of the face panel mounting fasteners has an end disposed between the first wall face panel and the first wall, and further wherein the first layer of insulation is disposed between the end of each face panel mounting fastener and the first wall.

44. The apparatus of claim 43 wherein the first wall includes a plurality of wall studs, and further wherein the first layer of insulation is disposed between the end of each face panel mounting fastener and each of the wall studs.

45. The apparatus of claim 37 wherein the first layer of insulation is comprised of at least one insulating blanket disposed between adjacent spaced apart face panel mounting members.

46. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room;

a first layer of insulation disposed between the first wall face panel and the first wall; and a plurality of spaced apart face panel mounting members disposed between the first wall face panel and the first wall, wherein each of the face panel mounting members includes a displacement member disposed between the first wall face panel and the first wall, wherein the angle of orientation of the displacement member changes as the first wall face panel moves in response to changes in temperature inside of the burn room.

47. The apparatus of claim 46 wherein the first wall face panel covers substantially the entire first wall and is a floating wall face panel.

48. The apparatus of claim 46 further including an insulating strip disposed between each face panel mounting member and the first wall face panel.

49. The apparatus of claim 46 wherein each of the face panel mounting members is a z-shaped mounting member.

50. The apparatus of claim 46 further including a plurality of face panel mounting fasteners attaching the first wall face panel to the plurality of face panel mounting members, wherein the first layer of insulation is disposed between each face panel mounting fastener and the first wall.

51. The apparatus of claim 50 wherein each of the face panel mounting fasteners has an end disposed between the first wall face panel and the first wall, and further wherein the first layer of insulation is disposed between the end of each face panel mounting fastener and the first wall.

52. The apparatus of claim 51 wherein the first wall includes a plurality of wall studs, and further wherein the first layer of insulation is disposed between the end of each face panel mounting fastener and each of the wall studs.

53. The apparatus of claim 46 wherein the first layer of insulation is comprised of at least one insulating blanket disposed between adjacent spaced apart face panel mounting members.

54. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room;

a first layer of insulation disposed between the first wall face panel and the first wall;

a second wall, wherein the second wall adjoins the first wall and is disposed between the ceiling and the floor;

a second wall face panel attached to the second wall, wherein the second wall face panel is exposed to the inside of the live fire burn room, and further wherein the second wall face panel and the first wall face panel are configured inside of the burn room to move independently of each other as the temperature inside of the burn room changes;

a second layer of insulation disposed between the second wall face panel and the second wall;

a ceiling face panel attached to the ceiling, wherein the ceiling face panel is exposed to the inside of the burn room and further wherein the second wall face panel and the ceiling face panel are configured inside of the burn room to move independently of each other as the temperature inside of the burn room changes;

a ceiling layer of insulation disposed between the ceiling face panel and the ceiling; and a corner trim member attached to the first wall face panel and the ceiling face panel, wherein the corner trim member flexes to allow the first wall face panel and the ceiling face panel to move as the temperature inside of the burn room changes.

55. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room, and further wherein the first wall face panel is a corrugated face panel; and a first layer of insulation disposed between the first wall face panel and the first wall;

a ceiling face panel attached to the ceiling, wherein the ceiling face panel is exposed to the inside of the burn room;

a ceiling layer of insulation disposed between the ceiling face panel and the ceiling; and a corner trim member attached to the first wall face panel and the ceiling face panel, wherein the corner trim member flexes to allow the first wall face panel and the ceiling face panel to move in response to temperature changes inside of the burn room.

56. The apparatus of claim 55 wherein the first wall face panel covers substantially the entire first wall and is a floating wall face panel.

57. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room, and further wherein the first wall face panel is a corrugated face panel;

a first layer of insulation disposed between the first wall face panel and the first wall; and a plurality of spaced apart face panel mounting brackets connecting the first wall face panel to the first wall, wherein each of the face panel mounting brackets includes a flex member that flexes to allow the first wall face panel to move as the temperature inside of the burn room changes.

58. The apparatus of claim 57 wherein the first wall face panel is attached to the first wall in a manner that allows the first wall face panel to move in response to temperature changes inside of the burn room.

59. The apparatus of claim 57 further including an insulating strip disposed between each face panel mounting bracket and the first wall face panel.

60. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room, and further wherein the first wall face panel is a corrugated face panel; and a first layer of insulation disposed between the first wall face panel and the first wall; and a plurality of spaced apart face panel mounting brackets connecting the first wall face panel to the first wall, wherein each of the face panel mounting brackets includes a displacement member disposed between the first wall face panel and the first wall, wherein the angle of orientation of the displacement member changes as the first wall face panel moves in response to changes in temperature inside of the burn room.

61. The apparatus of claim 60 wherein the first wall face panel is attached to the first wall in a manner that allows the first wall face panel to move in response to temperature changes inside of the burn room.

62. The apparatus of claim 60 further including an insulating strip disposed between each face panel mounting bracket and the first wall face panel.

63. An apparatus for training firefighters comprising:

a burn room configured to contain a continuous live training fire during a firefighter training exercise without sustaining damage to the burn room, wherein the burn room includes a ceiling, a floor, and a wall, wherein the wall is disposed between the ceiling and the floor;

a wall face panel attached to the wall and disposed on the inside of the burn room, wherein the wall face panel is a corrugated face panel;

a ceiling face panel attached to the ceiling and disposed on the inside of the burn room, wherein the ceiling face panel is a corrugated face panel; and a plurality of wall face panel mounting brackets connecting the wall face panel to the wall, wherein each of the wall face panel mounting brackets includes a flex member that flexes to allow the wall face panel to move as the temperature inside of the burn room changes.

64. The apparatus of claim 63 further including a layer of insulation disposed between the ceiling face panel and the ceiling.

65. The apparatus of claim 63 wherein each of the wall face panel mounting brackets is a z-shaped mounting bracket.

66. The apparatus of claim 63 further including an insulating strip disposed between each wall face panel mounting bracket and the wall face panel.

67. The apparatus of claim 63 wherein each of the wall face panel mounting brackets displaces the wall face panel away from the wall.

68. The apparatus of claim 63 further including a layer of insulation disposed between the wall face panel and the wall.

69. The apparatus of claim 68 further including a plurality of wall face panel mounting fasteners attaching the wall face panel to the plurality of wall face panel mounting brackets, wherein each of the wall face panel mounting fasteners has an end disposed between the wall face panel and the wall, and further wherein the layer of insulation is disposed between the end of each wall face panel mounting fastener and the wall.

70. The apparatus of claim 69 wherein the wall includes a plurality of wall studs, and further wherein the layer of insulation is disposed between the end of each wall face panel mounting fastener and each of the wall studs.

71. An apparatus for training firefighters comprising:

a burn room configured to contain a continuous live training fire during a firefighter training exercise without sustaining damage to the burn room, wherein the burn room includes a ceiling, a floor, and a wall, wherein the wall is disposed between the ceiling and the floor;

a wall face panel attached to the wall and disposed on the inside of the burn room, wherein the wall face panel is a corrugated face panel;

a ceiling face panel attached to the ceiling and disposed on the inside of the burn room, wherein the ceiling face panel is a corrugated face panel; and a plurality of wall face panel mounting brackets connecting the wall face panel to the wall, wherein each of the wall face panel mounting brackets includes a displacement member disposed between the wall face panel and the wall, wherein the angle of orientation of the displacement member changes as the wall face panel moves in response to changes in temperature inside of the burn room.

72. The apparatus of claim 71 further including a layer of insulation disposed between the ceiling face panel and the ceiling.

73. The apparatus of claim 71 wherein each of the wall face panel mounting brackets is a z-shaped mounting bracket.

74. The apparatus of claim 71 further including an insulating strip disposed between each wall face panel mounting bracket and the wall face panel.

75. The apparatus of claim 71 further including a layer of insulation disposed between the wall face panel and the wall.

76. The apparatus of claim 75 further including a plurality of wall face panel mounting fasteners attaching the wall face panel to the plurality of wall face panel mounting brackets, wherein each of the wall face panel mounting fasteners has an end disposed between the wall face panel and the wall, and further wherein the layer of insulation is disposed between the end of each wall face panel mounting fastener and the wall.

77. The apparatus of claim 76 wherein the wall includes a plurality of wall studs, and further wherein the layer of insulation is disposed between the end of each wall face panel mounting fastener and each of the wall studs.

78. An apparatus for training firefighters comprising:

a burn room configured to contain a continuous live training fire during a firefighter training exercise without sustaining damage to the burn room, wherein the burn room includes a ceiling, a floor, and a first wall, wherein the first wall is disposed between the ceiling and the floor;

a first wall face panel attached to the first wall, wherein the first wall face panel is exposed to the inside of the burn room, and further wherein the first wall face panel is a corrugated face panel;

a first layer of insulation disposed between the first wall face panel and the first wall;

a ceiling face panel attached to the ceiling, wherein the ceiling face panel is exposed to the inside of the burn room;

a ceiling layer of insulation disposed between the ceiling face panel and the ceiling; and a corner trim member, wherein the corner trim member includes a first outer leg member attached to the first wall face panel, a second outer leg member attached to the ceiling face panel, a first flex member connected at an angle to the first outer leg member, and a second flex member connected at an angle to the second outer leg member and at an angle to the first flex member, wherein the angle formed between the first and second flex members changes as the first wall face panel and the ceiling face panel move in response to temperature changes inside of the burn room.

* * * * *